US008015761B2

(12) United States Patent
Wainland

(10) Patent No.: US 8,015,761 B2
(45) Date of Patent: Sep. 13, 2011

(54) RE-ORIENTABLE STORAGE ASSEMBLY SUPPORTED ON BASE

(76) Inventor: Robert Andrew Wainland, Coral Springs, FL (US)

( * ) Notice: Subject to any disclaimer, the term of this patent is extended or adjusted under 35 U.S.C. 154(b) by 293 days.

(21) Appl. No.: 12/079,459

(22) Filed: Mar. 27, 2008

(65) Prior Publication Data

US 2008/0245280 A1 Oct. 9, 2008

Related U.S. Application Data

(63) Continuation-in-part of application No. 11/973,422, filed on Oct. 9, 2007, now abandoned, which is a continuation-in-part of application No. 11/705,216, filed on Feb. 12, 2007.

(51) Int. Cl.
*E04B 5/43* (2006.01)

(52) U.S. Cl. ..... 52/177; 108/42; 108/47; 108/157.1

(58) Field of Classification Search ..... 52/177, 52/179, 180, 630, 592.5, 592.6; 108/42, 108/47, 56.3, 57.26, 57.33, 157.11; 248/250
See application file for complete search history.

(56) References Cited

U.S. PATENT DOCUMENTS

| | | | | | |
|---|---|---|---|---|---|
| 112,925 | A * | 3/1871 | Johnson | 52/592.6 |
| 2,583,838 | A * | 1/1952 | Hart | 108/42 |
| 2,797,973 | A * | 7/1957 | Culpepper | 108/157.11 |
| 3,751,867 | A * | 8/1973 | Layne | 52/592.6 |
| 3,797,180 | A * | 3/1974 | Grange | 52/630 |
| 3,995,593 | A | 12/1976 | Bowser | |
| 4,255,914 | A | 3/1981 | Seipos | |
| 4,446,660 | A | 5/1984 | Miller et al. | |
| 4,879,856 | A | 11/1989 | Jones et al. | |
| 5,058,352 | A | 10/1991 | Loiselle et al. | |
| 5,239,790 | A | 8/1993 | Fetzer | |
| 5,388,533 | A * | 2/1995 | Pigott et al. | 108/56.3 |
| 5,544,459 | A | 8/1996 | Konger | |
| 5,628,153 | A | 5/1997 | Fontanez | |
| 5,836,133 | A | 11/1998 | Bergeron et al. | |
| 5,845,979 | A | 12/1998 | Longhurst et al. | |
| 5,984,249 | A * | 11/1999 | Cohen | 108/47 |
| 6,968,652 | B1 | 11/2005 | Eadie | |
| 7,591,105 | B2 * | 9/2009 | Balser | 52/29 |
| 2005/0016098 | A1 | 1/2005 | Hahn | |
| 2005/0028469 | A1 | 2/2005 | Grohman | |
| 2005/0204677 | A1 | 9/2005 | Mei | |
| 2005/0258722 | A1 | 11/2005 | Sullivan | |
| 2006/0075711 | A1 | 4/2006 | Landey | |
| 2007/0028550 | A1 * | 2/2007 | Clapper | 52/650.3 |
| 2008/0191110 | A1 | 8/2008 | Wainland | |

* cited by examiner

*Primary Examiner* — Eileen Lillis
*Assistant Examiner* — Matthew J Smith
(74) *Attorney, Agent, or Firm* — Malloy & Malloy, P.A.

(57) ABSTRACT

A storage assembly structured to be supported on a base is presented, wherein the base includes a plurality of spaced apart beams. At least one embodiment of the storage assembly includes a platform and at least one mounting device attached or otherwise connected to the platform. The mounting device(s) comprises an attachment mechanism which is structured to be removably engaged with the base and/or one or more beams thereof. Further, in at least one embodiment, the mounting device(s) is disposed and structured to removably support the platform in a predetermined spaced relation to said base.

12 Claims, 31 Drawing Sheets

RE-ORIENTABLE STORAGE ASSEMBLY SUPPORTED ON BASE

CLAIM OF PRIORITY

The present application is a Continuation-In-Part application of Ser. No. 11/973,422 filed Oct. 9, 2007, now abandonded which is a Continuation-In-Part application of previously filed, currently pending patent application having Ser. No. 11/705,216 and a filing date of Feb. 12, 2007, each of which are incorporated herein in their entirety by reference.

BACKGROUND OF THE INVENTION

1. Field of the Invention

The present specification relates to a storage assembly structured to be supported on a base, which may be disposed in an attic or other like location of a house, dwelling, building, or other structure. The storage assembly of the present specification includes a platform and at least one or a plurality of mounting devices attached thereto. In addition, the mounting devices include an attachment mechanism structured to removably engage the base.

2. Description of the Related Art

Many buildings, houses, and other like structures include accessible attic compartments between the inner ceiling and roof, which typically yield a large, at least partially open area. Furthermore, the floors of many of the attics today include a plurality of spaces, which may or may not be open, defined by the beams, joists, or bottom chords of the trusses of the roof and the unprotected ceiling panels secured thereto. In addition, many of these spaces may typically be at least partially filled with insulation or other like material.

Furthermore, individuals and/or families whether living or working in the building or just merely utilizing the premises, may have the desire to store some or all of their belongings in the attic or other similar location. In addition, some individuals may want to transform or build their attic into an additional room to expand their living and/or working quarters.

Unfortunately, however, the typically structured attic is not designed or even capable of supporting heavy loads exerted from, for example, storage boxes, bags, carts, trunks, and/or individuals crawling, walking, or standing thereon. Specifically, the ceiling tile will typically crack or break when such a load is exerted thereon. Thus, the large, at least partially open areas provided by most attics are not being utilized to their fullest potential, if at all.

As such, there is a current need in the art for a support and/or storage assembly structured to be operatively connected to a base structure such as, for example, the bases, structure beams, and/or bottom chords of the trusses on the floor of an attic. The proposed assembly may be structured to at least partially cover or protect the vulnerable spaces on the floor of the attic to provide sufficient support for heavy loads to be placed or exerted thereon.

Additionally, such a proposed assembly may include at least one, or a plurality of mounting devices and at least one overlying member and/or platform cooperatively structured to be connectable thereto. Furthermore, the mounting devices of the proposed support assembly may include an attachment mechanism structured to be removably connected or engaged to the base structure.

It would be particularly beneficial if the proposed support assembly could be operatively and removably connected to the base structure without the need for tools or other external devices. As such, the proposed assembly may be easily assembled, mounted, and/or disassembled as desired to fit the particular need or circumstance.

It would also be beneficial if the proposed assembly includes a height measured between the base structure and the support assembly wherein an opening may be defined therein. Such an opening may be dimensioned to allow existing and/or subsequently installed pipes, wires, or other like structures or devices to be unobstructed by the proposed support assembly while in its operative and assembled orientation.

It would further be advantageous if the mounting device is structured to be at least partially connectable to a top chord or web of a truss, or any other similar location. As such, the mounting device may be utilized for mounting shelves, fishing rods, and/or hanging other objects or devices therefrom.

Furthermore, it would be beneficial if the proposed support and/or storage assembly includes a plurality of walls disposed in an at least partially surrounding relation to the platform. Accordingly, the platform and the plurality of walls are structured and disposed to define a storage receptacle including an at least partially hollow interior compartment. It would be particularly beneficial if the proposed storage receptacle is cooperatively structured to allow storage of various items, devices, mechanisms, etc. therein.

SUMMARY OF THE INVENTION

The present specification is related to a support and/or storage assembly that may connect to or engage with a base structure which may be located in an attic of a house, apartment, dwelling, or other structure, but is in no way limited to such locations. Moreover, the support assembly of the present invention may be utilized to fit a plurality of needs or circumstances including but not limited to increasing and/or adding storage space through, for example, the provision of one or more supporting platforms or surfaces to facilitate an individual to stand and/or maneuver around upon. As such, the support assembly of the present invention may preferably be disposed on or across a beam or other like base structure of an attic to at least partially cover or overlie the spaces typically filled with insulation or other like material.

The support assembly of the present invention may include at least one or a plurality of mounting devices and at least one overlying member, such as a panel and/or platform. In at least one embodiment, each of the mounting devices include an upper portion and an attachment mechanism, wherein the attachment mechanism is structured to be at least partially disposed on, connected to, and/or engaged with the base structure. In at least one preferred embodiment of the support assembly of the present invention, the attachment mechanism is structured to at least partially overlie the base structure so as to be removably connected thereto.

In addition, the attachment mechanism of at least one embodiment of the present invention may include an irregular surface configuration which may be at least partially defined by an array of teeth. The irregular surface configuration and/or teeth may be disposed and structured to provide an at least partially gripping engagement between the attachment mechanism and the cooperatively oriented base structure.

Moreover, the attachment mechanism may further include a tightening assembly. Specifically, the tightening assembly of at least one embodiment comprises a fastener that may either penetrate the surface of the base structure or provide an engagement therewith at least partially solely on the basis of pressure and friction. Either way, the fastener may be at least partially manipulated by hand, which may preferably be structured to minimize or completely eliminate the need for tools or other external devices to facilitate the tightening or loosening thereof. As such, the fastener may include a thumb screw or an equivalent structure. In addition, however, the fastener may include a conventional type screw which may require the utilization of a screw driver or other like tool to tighten or loosen.

Common to each of the various preferred embodiments of the support assembly of the present invention is the cooperative structuring of confronting portions of the mounting devices and the one or more panels supported thereby in order to establish a stable but removable connection therebetween. More specifically, in at least one preferred embodiment of the present invention, each of the mounting devices may include at least one or a plurality of outwardly protruding portions, such as, for example, raised tabs. The protruding portions may be structured in any number, shape, length, or orientation.

In addition, the support assembly of the present invention may further include at least one or a plurality of overlying members having an upper surface and a lower surface. The overlying member may preferably be constructed from particle board. However, other materials may be utilized such as plywood, medium-density fibreboard (MDF or MDFB), metal, plastic, or any other like material.

The lower surface of the overlying member and/or platform in at least one embodiment of the present invention may be structured to define at least one or a plurality of receiving slots thereon. The receiving slots may be cooperatively structured such that the protruding portions or tabs of the mounting devices may be removably disposed therein. Further, the receiving slots may be structured to have a dimension slightly larger than that of the protruding portions of the mounting devices. More in particular, the length, width, and/or depth of the receiving slots may be larger, albeit only minimally, so as to allow some movement and/or adjustment of the overlying member(s) or mounting device(s).

Moreover, at least one alternate embodiment of the present invention may further include a substantially "reversed" configuration wherein the overlying member includes at least one or a plurality of protruding portions, for example, tabs disposed on or along the lower surface thereof. The protruding portions may be located substantially near the edges of the overlying member or closer to the center thereof. Additionally, the mounting devices of the "reversed" embodiment of the present invention may be structured to define at least one or a plurality of receiving slots cooperatively structured and dimensioned such that the protruding portions of the overlying member may be removably insertable therein.

Additionally, in at least one embodiment of the present invention, the mounting device(s) may be dimensioned and configured to dispose the panel member and/or platform above and/or in outwardly spaced relation from the base to facilitate the placement of pipes, wiring, and other utilitarian devices between the base and corresponding panel. More in particular, the support assembly may be structured to have a height such that when the support assembly of the present invention is completely assembled and operatively disposed on the base structure, the distance between the base structure and the overlying member defines an opening therethrough. The opening may be of a sufficient dimension to allow pipes, wiring, and other like devices and structures to pass through unobstructed by the support assembly of the present invention.

In yet another embodiment of the present invention, the support assembly includes at least one anchoring assembly structured to connect the mounting device(s) to the panel member. In such an embodiment, the mounting device(s) may be disposed in any one of a plurality of orientations relative to the panel member. In particular, the mounting device(s) may rotate and/or slide along a lower surface of the panel member and be disposed in a custom orientation to fit any one of a plurality of spaced apart truss members, beams, or other base structures.

Furthermore, in at least one embodiment of the present invention, the storage assembly includes at least one support portion disposed in a confronting and supporting relation to the base structure, and at least one stabilizing portion extending outwardly from the support portion. The support portion and the stabilizing portion are cooperatively disposed to define a substantially "L" shaped configuration disposable in overlying relation to an inner longitudinal edge of the base. Additionally, in yet another embodiment, the storage assembly includes a plurality of walls disposed in a surrounding relation to a platform, wherein the platform and the walls are structured to define a storage receptacle having an at least partially hollow interior compartment. The storage receptacle may be removably engaged to the base via at least one mounting device including an attachment mechanism.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
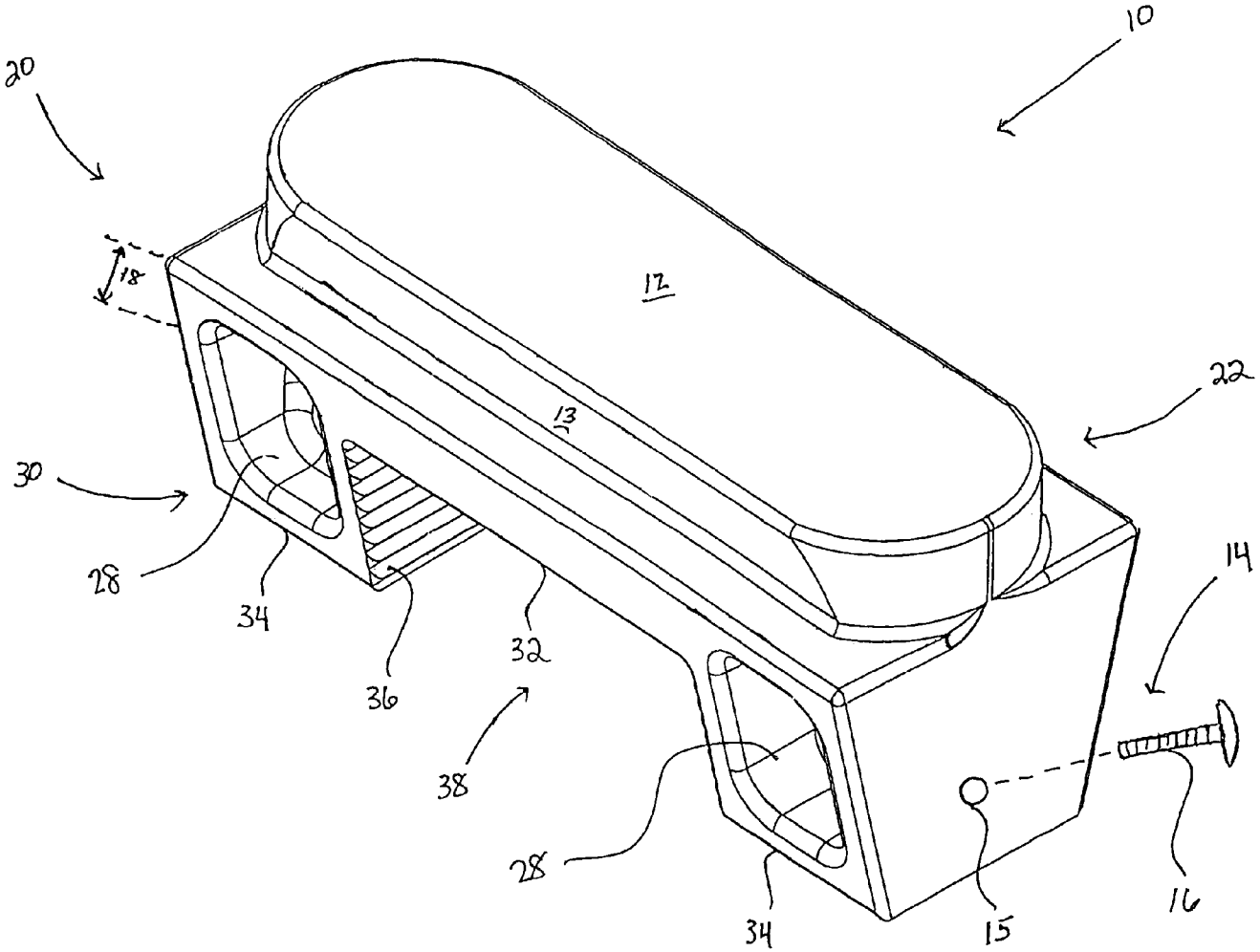
FIG. 1 is a schematic representation of a preferred embodiment of a mounting device of the present invention.

As shown in the accompanying drawings, at least one embodiment of the present specification is directed to a support and/or storage assembly, generally indicated as 10, which is connectable to a base structure 50. The base structure 50 may include one or more beam(s), joist(s), or any portion (s) of a truss, including but not limited to the top chord(s), bottom chord(s), and/or web(s). In addition, the base structure 50 may include any other structure preferably located in an attic of a house, apartment, or other dwelling, building, or structure. As will become apparent from the following discussion, the base 50 in at least one embodiment includes a plurality of spaced apart structures, such as joists, trusses, chords, or other beams or like structures. The base 50, however, is in no way limited to structures or locations, and as such, the base 50 may be vertically oriented, as in a wall, or disposed in any other conceivable angle. Additionally, the base 50 may be disposed at any height or elevation, for example, near a ceiling or roof of a house, building, etc.

As such, the support and/or storage assembly 10 of the present invention is versatile in that it may be utilized to fit a plurality of needs or circumstances, including, for example, to increase storage space, or provide additional surface(s) to facilitate an individual to walk, crawl, and/or stand thereon. In addition, the assembly 10 of the present specification may provide enclosures and/or panels for ceilings, walls, etc.

As will be described in further detail below, the support and/or storage assembly 10 of the present invention may preferably be disposed across and/or along the beams, joists, trusses, or other bases 50 to at least partially cover or overlie the open spaces in an attic typically filled with insulation or other like material or objects. In addition, the base 50 may include any other substantially or partially stable member whether located in an attic or not.

In at least one embodiment of the present invention, the support and/or storage assembly 10 may include at least one or a plurality of mounting devices 20. The mounting devices 20 may be connected to the base 50, such as, for example, the web and/or top chord of a truss or other beams. Accordingly, the mounting devices 20 may facilitate the mounting and/or hanging of shelves, fishing rods, or any other structures or devices there from.

Figure 3:
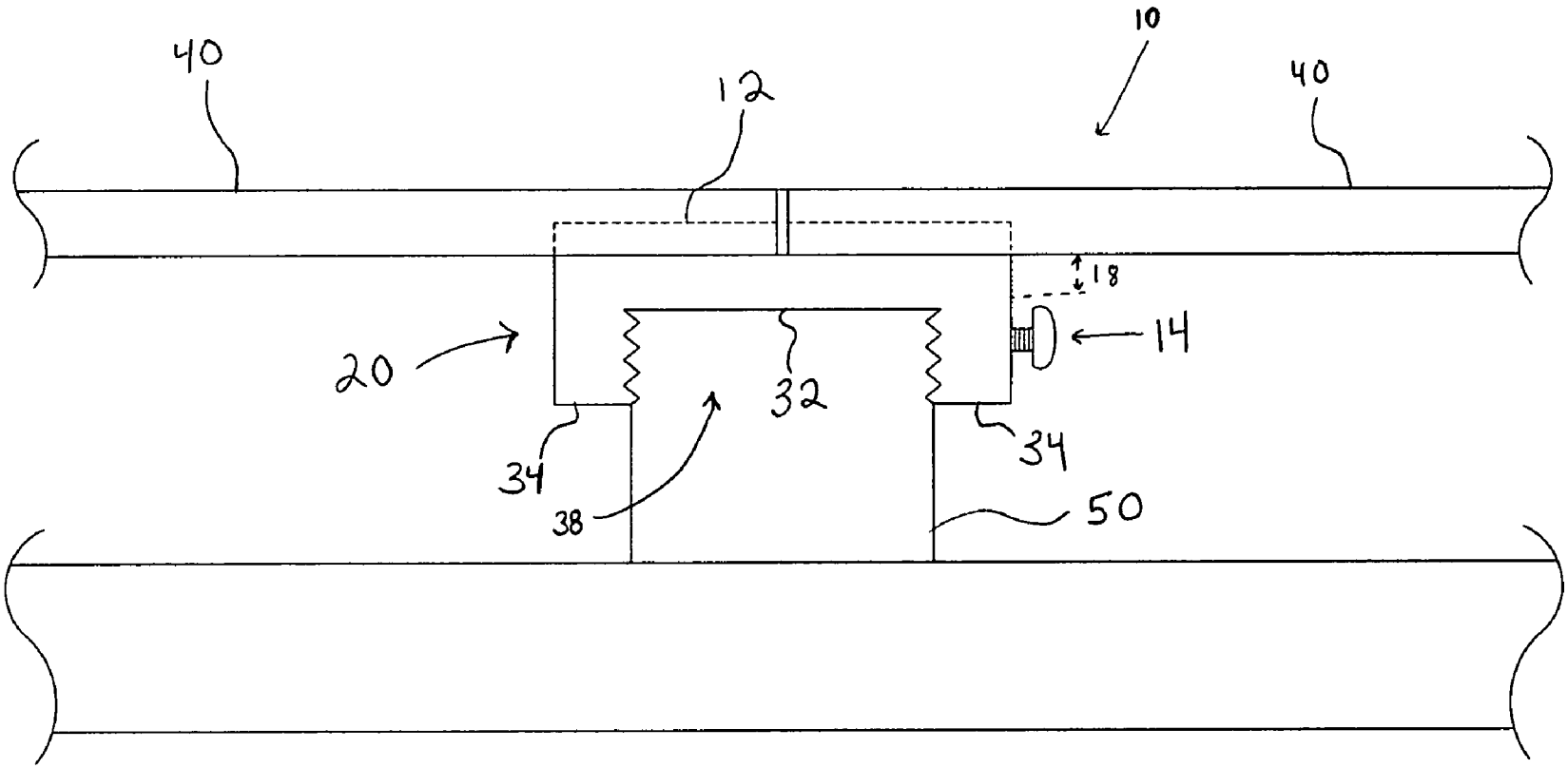
FIG. 3 is a schematic representation of a side view of a preferred embodiment of the support assembly connected to a base structure of the present invention.
Figure 3A:
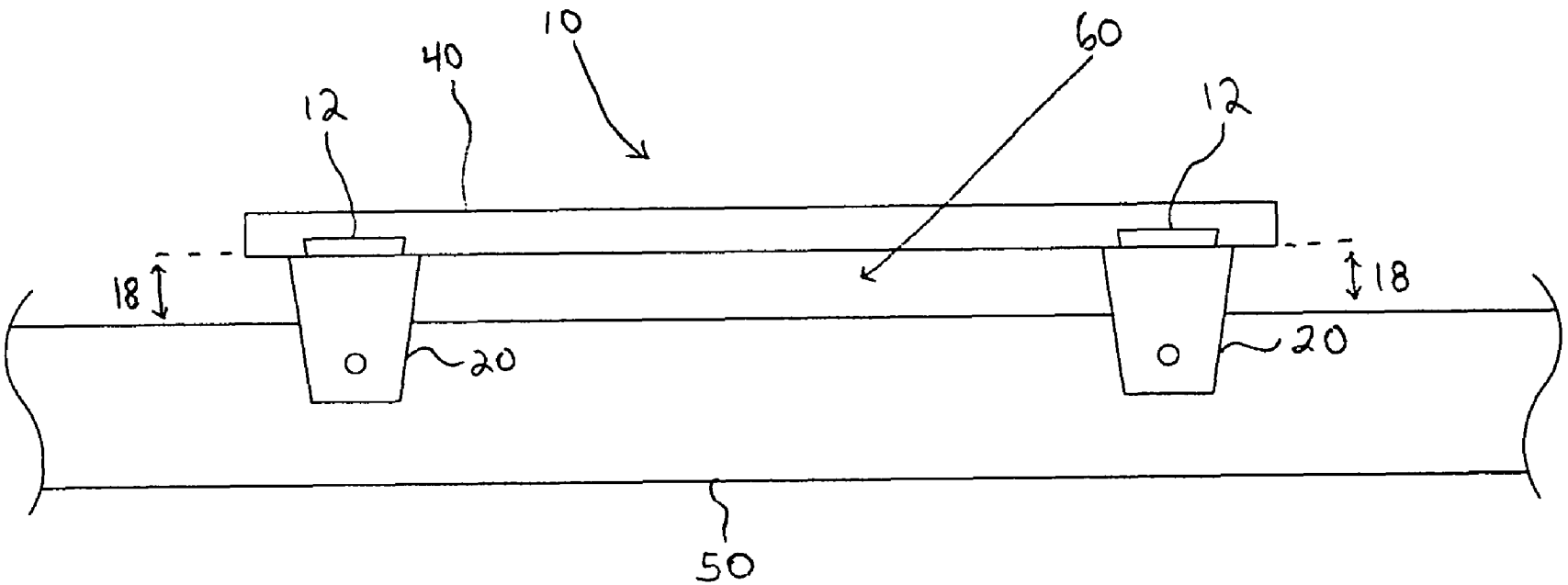
FIG. 3*a* is a schematic representation of a front view of the support assembly connectable to a base structure of FIG. 3.
Figure 3B:
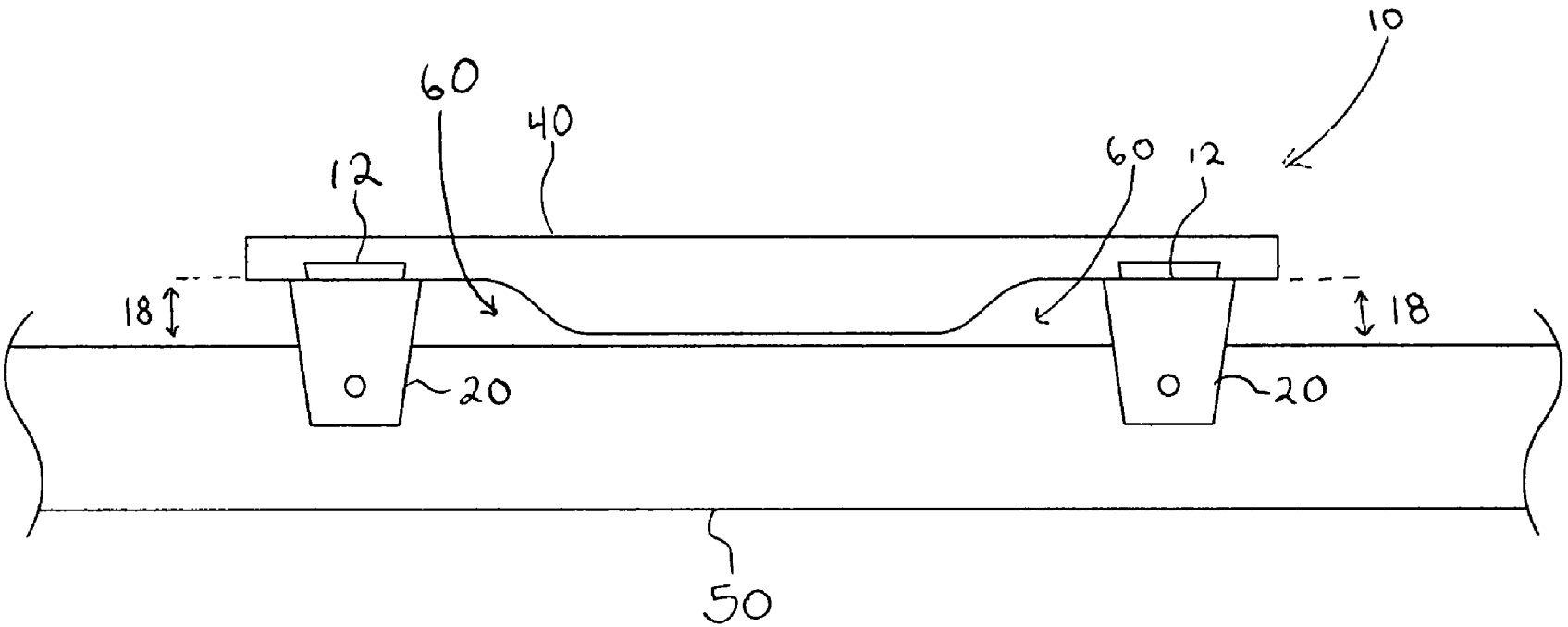
FIG. 3*b* is a schematic representation of a variation of the embodiment of the support assembly connectable to a base structure of FIG. 3*a*.
Figure 4:
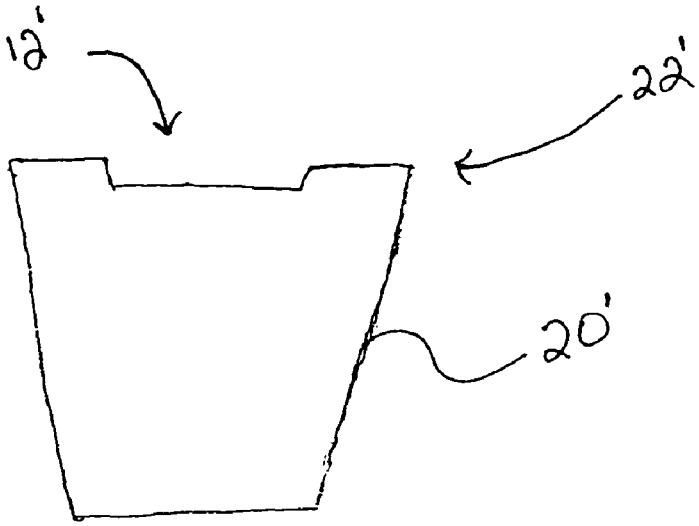
FIG. 4 is a schematic representation of a side view of another embodiment of the mounting device of the present invention.
Figure 4A:
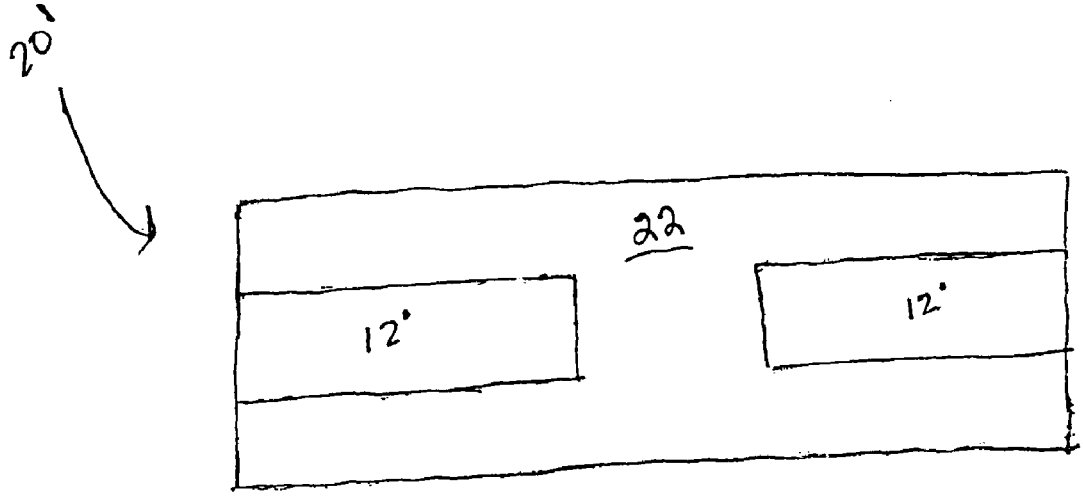
FIG. 4*a* is a schematic representation of a top view of the mounting device in the embodiment of FIG. 4.

Further, in at least one embodiment of the present invention, the assembly 10 may include at least one but more practically a plurality of mounting devices 20 and at least one overlying member 40, such as a panel and/or platform. As shown in FIG. 1, the mounting devices 20 of at least one embodiment include an upper portion 22 and an attachment mechanism 30. As will be described in greater detail below, the attachment mechanism 30 may be structured to connect to or otherwise engage the base 50, as shown in FIGS. 3, 3*a*, and 3*b*. Accordingly, the attachment mechanism 30 of the present invention may be structured to be operatively disposed in an at least partially overlying manner to an external surface of the base structure 50. In addition, as will also be described in greater detail below, the attachment mechanism 30 may be temporarily or at least partially permanently secured to the base structure 50.

Moreover, as illustrated in FIG. 1, the attachment mechanism 30 in at least one embodiment of the present invention includes at least one, but preferably two spaced apart, outwardly extending members, such as support portions or legs 34. The legs 34 may be operatively connected in a spaced apart relation by member 32 disposed there between, defining a channel 38 therein. As shown in FIG. 3 and described below, the channel 38 may be dimensioned and configured to facilitate the connection of the mounting device 20 to the base structure 50. More in particular, the channel 38 may be structured to cooperatively receive the base 50 therein.

Additionally, in at least one embodiment of the present invention, as shown in FIG. 1, the attachment mechanism 30 may include an irregular surface configuration which may at least partially be defined by teeth 36 disposed on an inner surface of the channel 38. Further, the irregular surface configuration, or teeth 36, may be disposed in engaging confronting relation with the base structure 50. Moreover, the teeth 36 may operate to facilitate the gripping engagement between the attachment mechanism 30 and the base structure 50. Specifically, the teeth 36 may at least partially grip and/or frictionally engage the surface of the base structure 50 to securely connect the attachment mechanism 30 thereon.

Furthermore, the attachment mechanism 30 may also include a tightening assembly 14 structured to further facilitate the connecting of the attachment mechanism 30 to the base structure 50. As shown in FIG. 1, at least one of the legs 34 may be structured to define a bore 15 extending completely therethrough. As such, the tightening assembly 14 may include a fastener 16 structured to be cooperatively disposed within the bore 15 and comprising a sufficient length to pass completely therethrough and into engaging contact with the base structure 50.

The fastener 16 of the present invention may include a conventional screw such that the use of a screw driver or other like device may be needed to operatively tighten and/or loosen the screw. In addition, a thumb screw or other similar structure may preferably be utilized to effectively eliminate the need for tools or other such external devices.

Moreover, the fastener 16 may be structured to operatively penetrate the surface of the base structure 50 to facilitate an at least partially permanent connection of the attachment mechanism 30 thereto. On the other hand, however, the fastener 16 may be structured to merely engage the surface of the base structure 50 by way of pressure or friction. Further, however, rather then a fastener 16, the tightening assembly 14 may comprise any other structure such as a ratcheting mechanism to securely connect or engage the attachment mechanism 30 to the base structure 50.

Figure 1A:
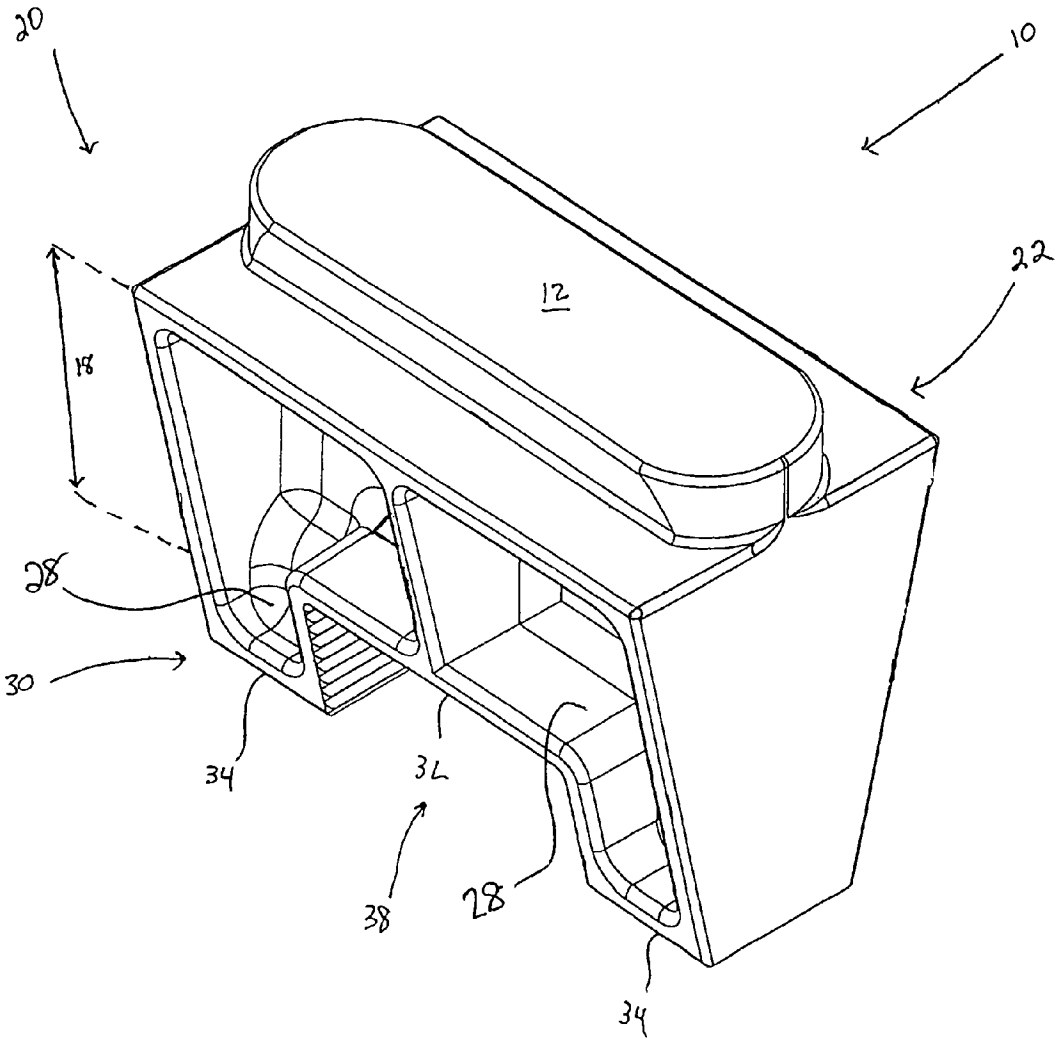
FIG. 1*a* is a schematic representation of another embodiment of a mounting device of the present invention.
Figure 1B:
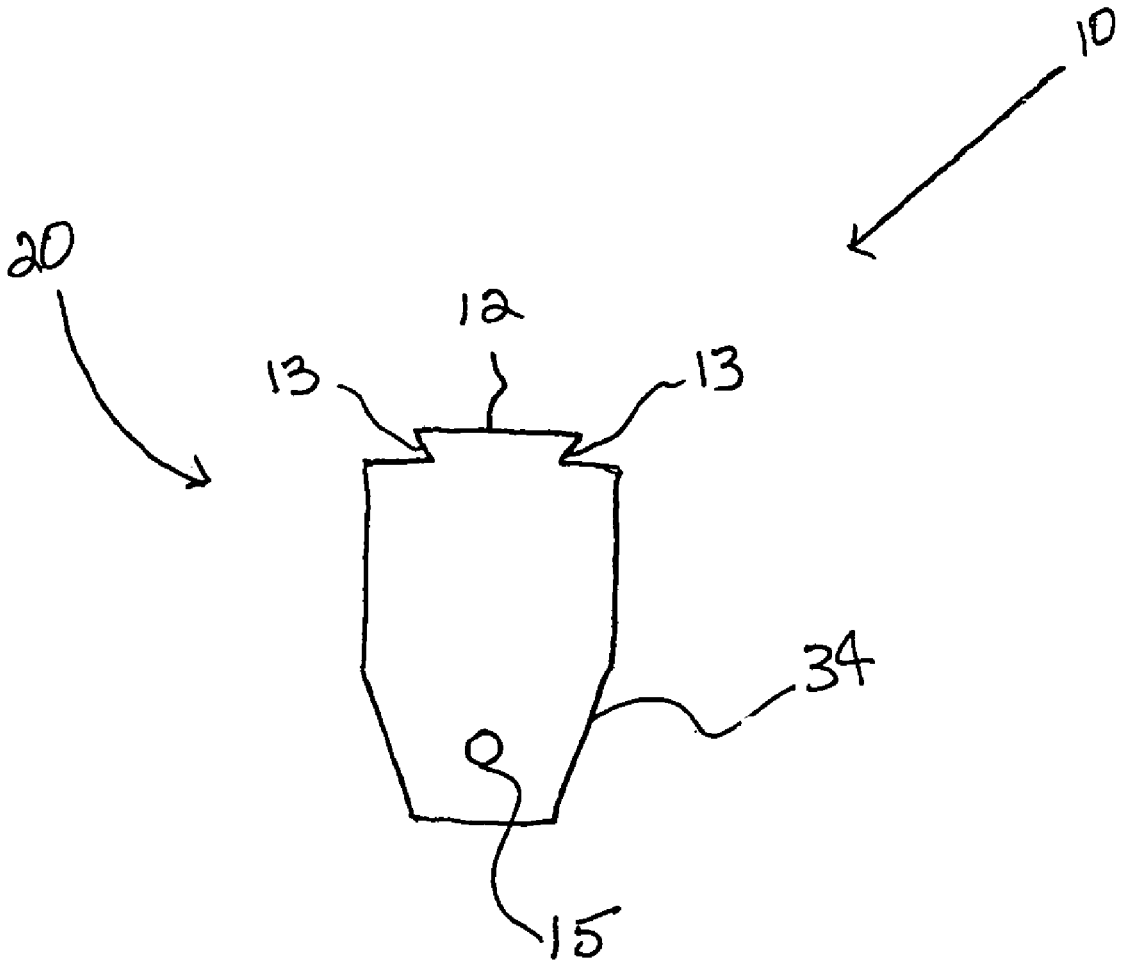
FIG. 1*b* is a schematic representation of an end view of the mounting device of FIG. 1*a*.

Still referring to FIGS. 1 and 1*a*, the upper portion 22 of the mounting device 20 of the present invention may include an outwardly projecting portion such as at least one raised tab 12. The raised tab 12 may be structured to extend substantially along the length of the upper portion 22 of the mounting device 20. In at least one embodiment of the present invention, the raised tab 12 may comprise an at least partially outwardly angled configuration. For example, the raised tab 12 may be at least partially defined by at least one, but more practically two, projecting side walls 13 extending along the length thereof. As best shown in FIG. 1*b*, the side walls 13 of the raised tab 12 may, but need not be at least partially angled in an outwardly orientation. Accordingly, the raised tab 12 may at least partially comprise a dove-tail configuration.

Figure 1C:
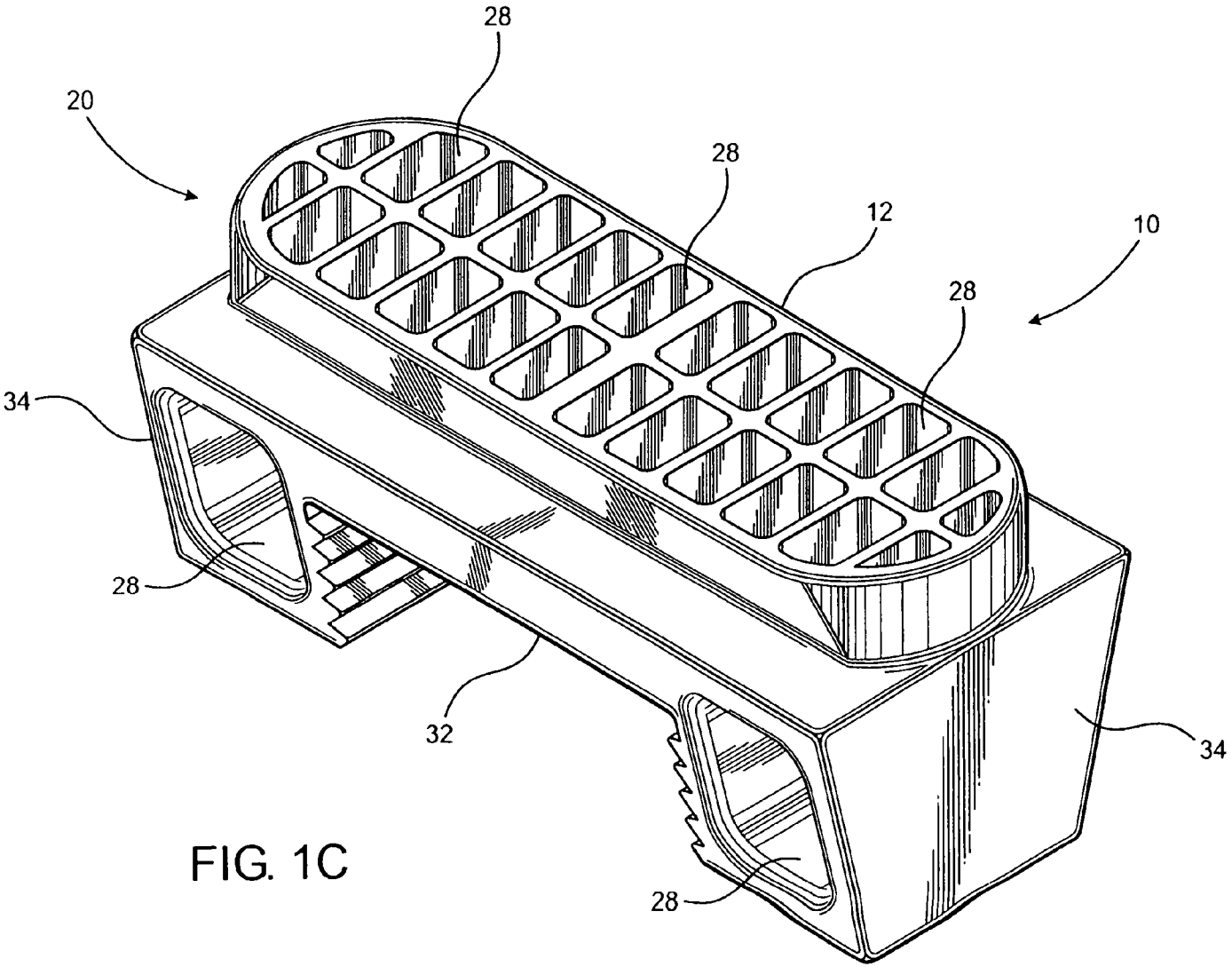
FIG. 1*c* is a schematic representation of another embodiment of a mounting device of the present invention.

In addition, the mounting devices 20 of the support assembly of the present invention may, but need not include at least one or a plurality of inwardly extending cavities 28. The cavities 28 are primarily structured to facilitate the manufacturing and/or molding process of the mounting devices 20 of the present invention. More in particular, as shown in FIGS. 1 and 1*a*, the cavities 28 may be disposed on or near the outwardly extending members, or legs 34. In addition, as illustrated in FIG. 1*c*, the cavities 28 may be disposed on the outwardly protruding portion, or raised tab 12.

As shown in FIGS. 2, 2*a*, 2*b* and 2*c*, and as also mentioned above, the support assembly 10 of the present invention may further include at least one overlying member 40, such as a panel member, having an upper surface 45 and a lower surface 46. The overlying member 40 may comprise a substantially rigid construction, and may preferably be constructed from particle board, however, other materials may be utilized, such as, plywood, medium-density fibreboard (MDF or MDFB), metal, plastic, or other like materials. Moreover, the overlying member 40 of the present invention may comprise any sufficient rigidity to at least partially support the particular load, if any, for its intended purpose.

Furthermore, the overlying member 40 of the present invention may be constructed in any of a plurality of dimensions, depending on the specific use, location, and/or requirements of the particular user. For example, it is common for the open spaces between the bottom chords of the trusses on the floor of an attic to have a width and/or length of about sixteen (16) inches or twenty four (24) inches on center, however, any dimension may be contemplated. Specifically, two adjacent beams of the base 50 may be disposed in any one or more of a plurality of supported orientations distinguishable by a variable spacing, such as sixteen (16) or twenty-four (24) inches on center, therebetween. Moreover, the overlying member 40 of at least one embodiment of the support and/or storage assembly 10 is cooperatively dimensioned to be disposed in overlying relation to the base 50, wherein the base includes beams disposed in any one or more of the plurality of supported orientations.

Similarly, the thickness of the overlying member 40 may vary in dimension depending on the specific use, location, and/or requirements of the particular user. For example, the overlying member 40 may preferably have a thickness of about between ¾ inches and ⅝ inches. However, since the use of the support assembly 10 of the present invention is not limited to the floors in an attic, the overlying member 40 may be constructed into many different lengths, widths, and/or thicknesses, including for example, a universal and/or adjustable size. In addition, as will be described below, the overlying member and/or platform 40 of at least one embodiment includes a corrugated configuration.

Figure 2:
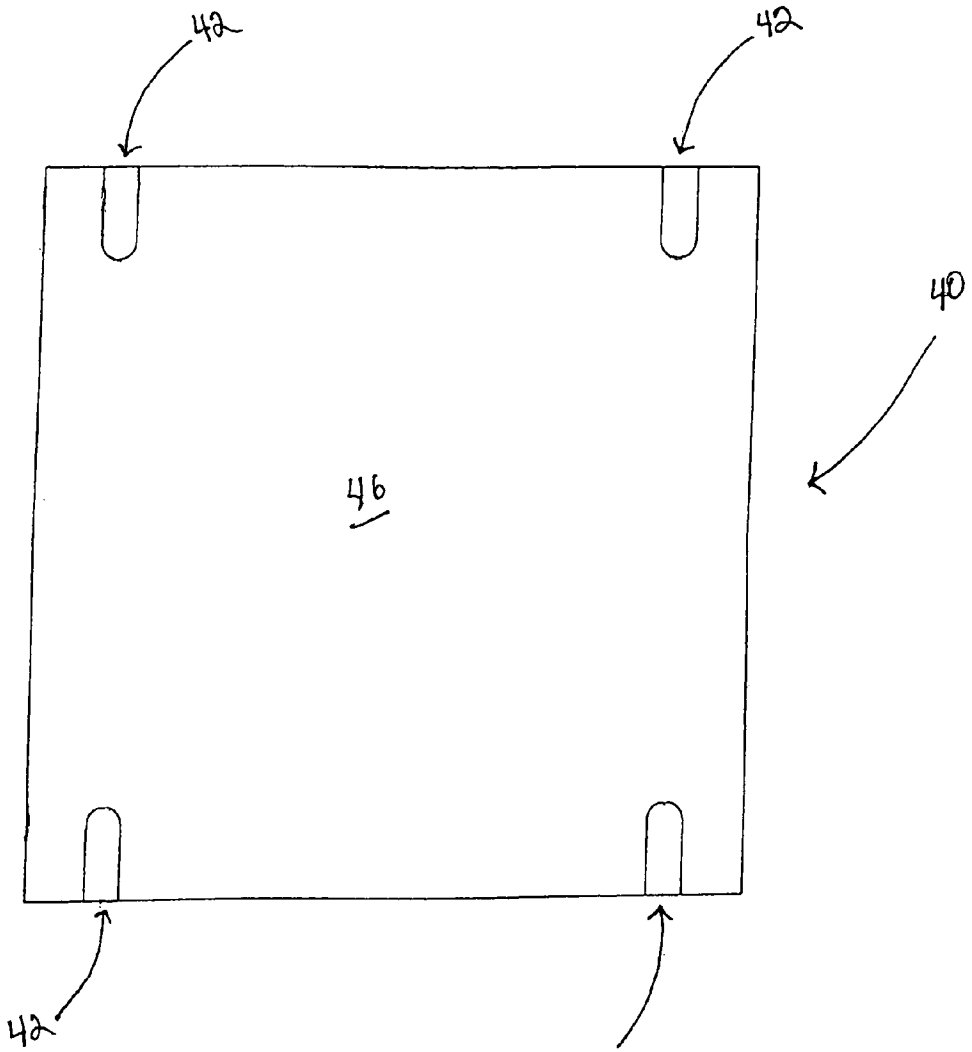
FIG. 2 is a schematic representation of a bottom view of a preferred embodiment of an overlying member of the present invention.
Figure 2A:
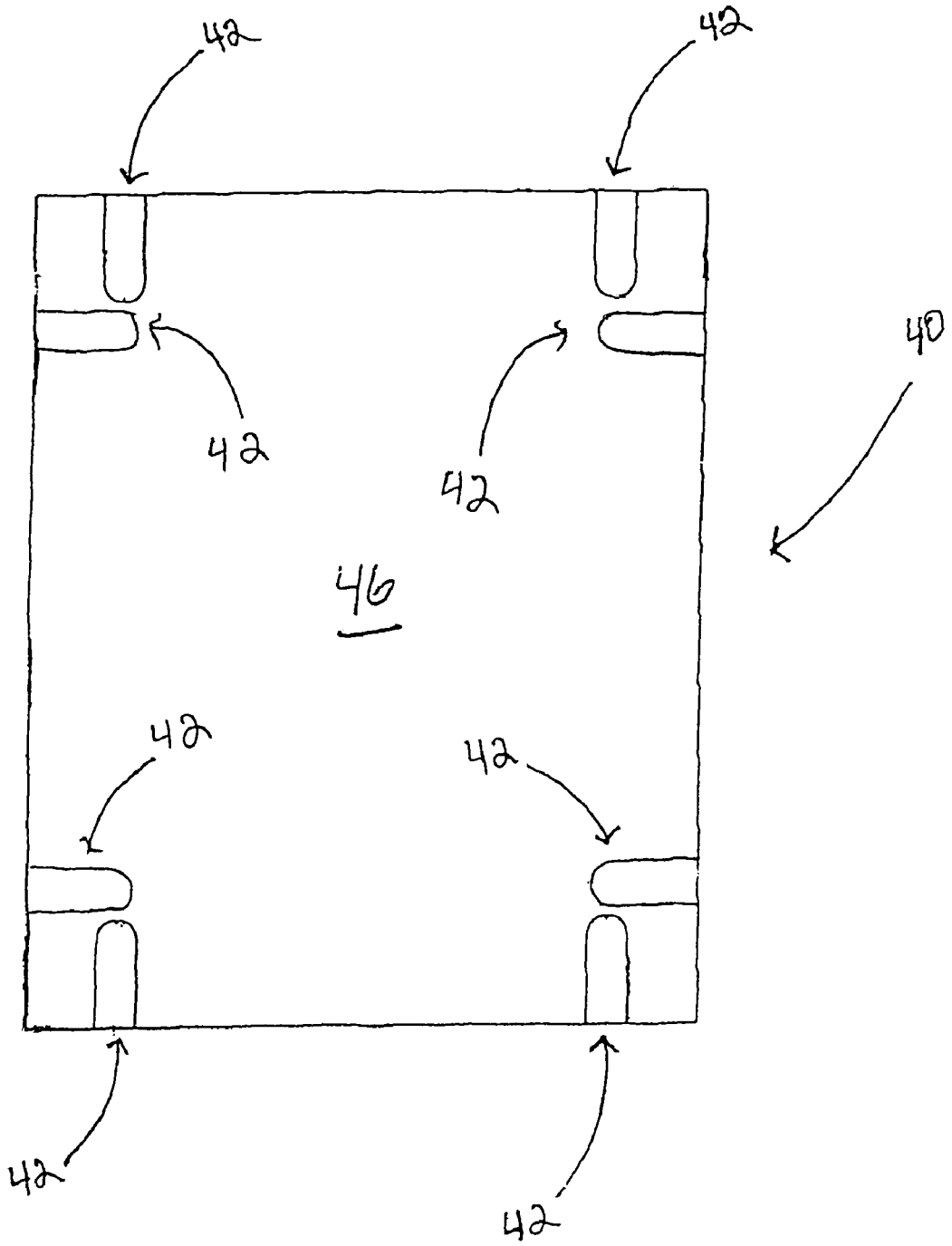
FIG. 2*a* is a schematic representation of a bottom view of at least one embodiment of an overlying member of the present invention.
Figure 2B:
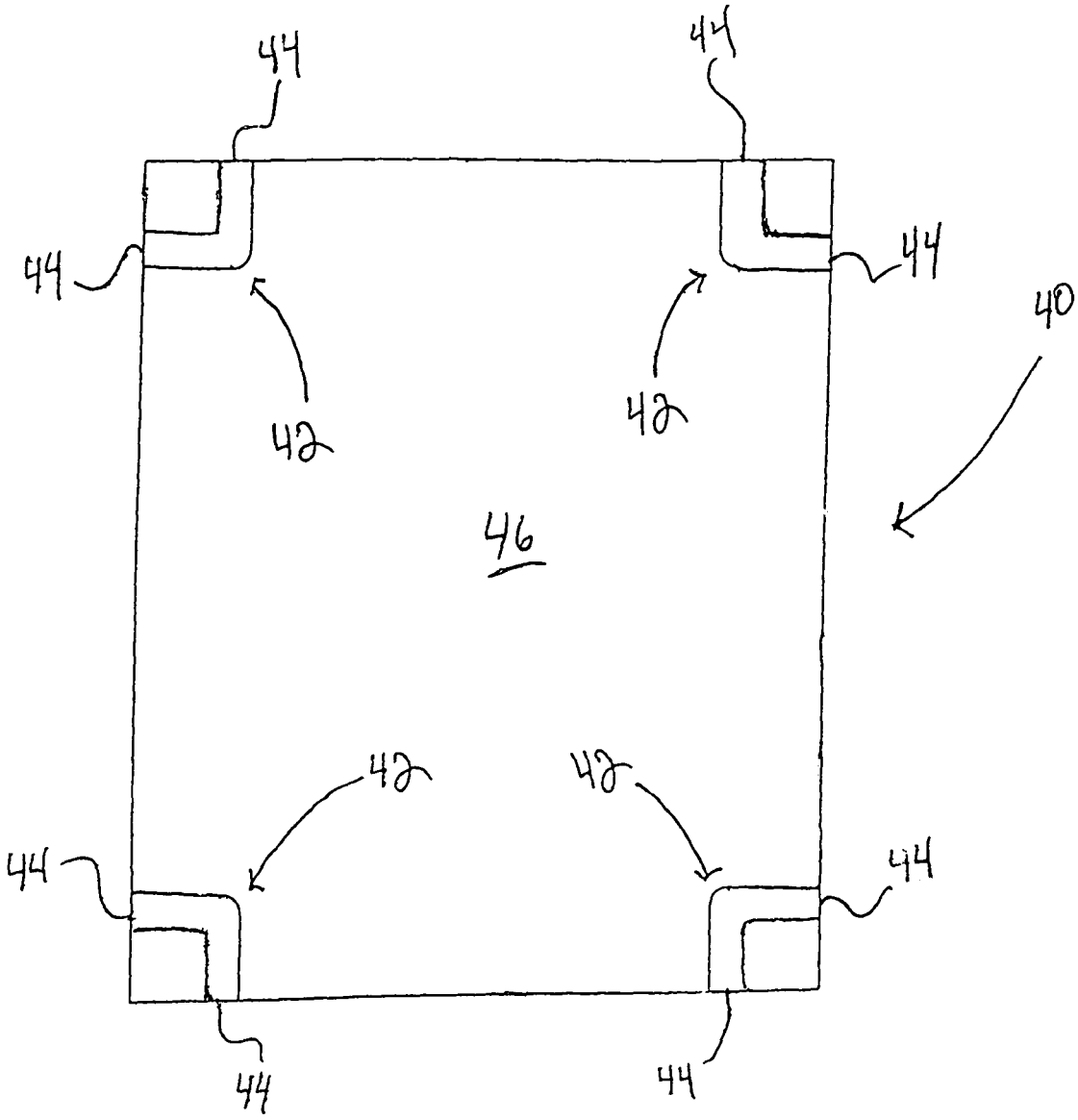
FIG. 2*b* is a schematic representation of a bottom view of at least one embodiment of an overlying member of the present invention.

In at least one embodiment of the present invention, as shown in FIGS. 2, 2*a*, and 2*b*, the lower surface 46 of the overlying member 40 may be structured to define at least one or a plurality of receiving slots 42. More in particular, the receiving slots 42 of the overlying member 40 may be cooperatively dimensioned and structured to be removably securable to the raised tabs 12 of the mounting devices 20.

As best shown in FIGS. 2, 2*a*, and 2*b*, the receiving slots 42 may be disposed substantially near the edges of the lower surface 46 of the overlying member 40. However, it is contemplated that the receiving slots 42 may instead be disposed anywhere along or on the lower surface 46, for example, closer to the center thereof. More in particular, as illustrated in FIG. 2*b*, the receiving slots 42 may be structured to form an at least partially L-shaped configuration. The L-shaped receiving slots 42 may be structured to operatively receive the outwardly protruding portion, or raised tab 12 of the mounting devices 20, from either one and/or both ends 44 thereof.

As such, the overlying member 40 may be utilized and/or disposed in a plurality of orientations, depending on the particular distance between the relative base structures 50 and/or beams thereof. More in particular, as previously described above, each of the beams, joists, or bases of the trusses in an attic may commonly be disposed a distance of sixteen (16) or twenty-four (24) inches on center, however any spaced apart dimensions or distances may be used or contemplated. Accordingly, the overlying member 40 may be universally dimensioned such that the width of the overlying member 40 is structured to facilitate the support and/or storage assembly 10 to be used with at least one spaced apart dimension of the base 50 and the length of the overlying member 40 is structured to facilitate the support and/or storage assembly 10 to be used with another spaced apart dimension of the base 50.

Figure 2C:
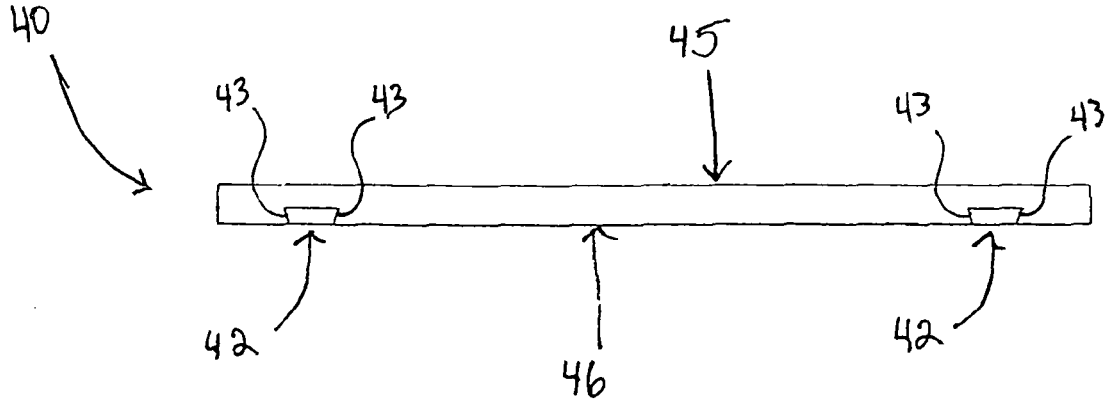
FIG. 2*c* is a schematic representation of a front view of the overlying member of FIG. 2.

Further, in at least one embodiment of the present invention, the receiving slots 42 may include at least one, but more practically at least two, side walls 43. As best shown in FIG. 2*c*, the side walls 43 may comprise an at least partially angled configuration relative to upper and lower surfaces 45 and 46.

Moreover, the side walls 43 of the receiving slots 42 may preferably be cooperatively structured with the orientation of the side walls 13 of the raised tabs 12 so as to create an at least partially locking and/or cooperative relationship therewith. In addition, the receiving slots 42 and the raised tabs 12 may be cooperatively structured to form a sliding engagement therewith. However, the raised tabs 12 may instead or additionally be insertable or engageable with the receiving slots 42 in a plurality of manners, for example, to facilitate a snap-like engagement therewith.

As illustrated in FIG. 3, the support assembly 10 of the present invention may be operatively disposed in an overlying relation to the base structure 50. Specifically, the base structure 50 may be received by the channel 38 so as to be cooperatively disposed in a confronting relation with the outwardly extending members 34 and member 32. In addition, FIG. 3 illustrates two overlying members 40 operatively connected to the outwardly protruding portion 12 of the mounting device 20.

Furthermore, referring again to FIGS. 1 and 1*a*, and as also shown in FIG. 3, the mounting devices 20 of the present invention each include an elevation height 18 defined by the distance between member 32 and upper portion 22. The elevation height 18 of the mounting devices 20 is preferably dimensioned and configured to dispose the overlying member 40 above and/or in an outwardly spaced relation from the base structure 50. The elevation height 18 may be minimal, as shown in FIG. 1. However, any elevation height 18 may be implemented, such as, for example, a larger elevation height as shown in the embodiment of FIG. 1*a*.

Moreover, as shown in FIGS. 3*a* and 3*b*, the elevation height 18 may be dimensioned to dispose the overlying member 40 a sufficient distance from the base structure 50 to define an opening 60 configured to facilitate the placement of pipes, wiring, and/or other utilitarian devices between the base structure 50 and the corresponding overlying member 40. More in particular, because the lower surface 46 of the overlying member 40 of the present invention may either be substantially flat, as shown in FIG. 3*a*, or at least partially downwardly protruding, as shown in FIG. 3*b*, the opening 60 may vary in dimension.

As shown in FIGS. 4, 4*a*, 5, and 5*a*, in at least one alternative embodiment of the present invention, the support assembly 10 may comprise a substantially "reversed" structural configuration for connecting the one or more mounting devices 20 to the one or more overlying members 50. Specifically, referring to FIGS. 4 and 4*a*, the upper portion 22' of the mounting devices 20' may be structured to define at least one or a plurality of receiving slots 12' thereon. The receiving slot(s) 12' may be disposed substantially near the edges of the mounting device 20', or closer to the center thereon.

Figure 5:
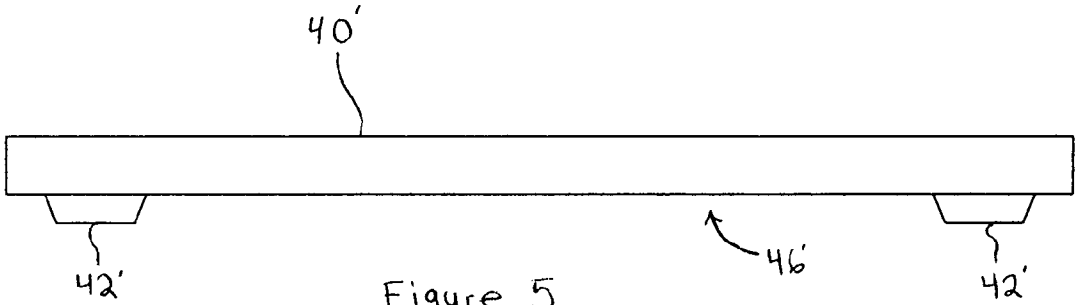
FIG. 5 is a schematic representation of a front view of another embodiment of the overlying member of the present invention.
Figure 5A:
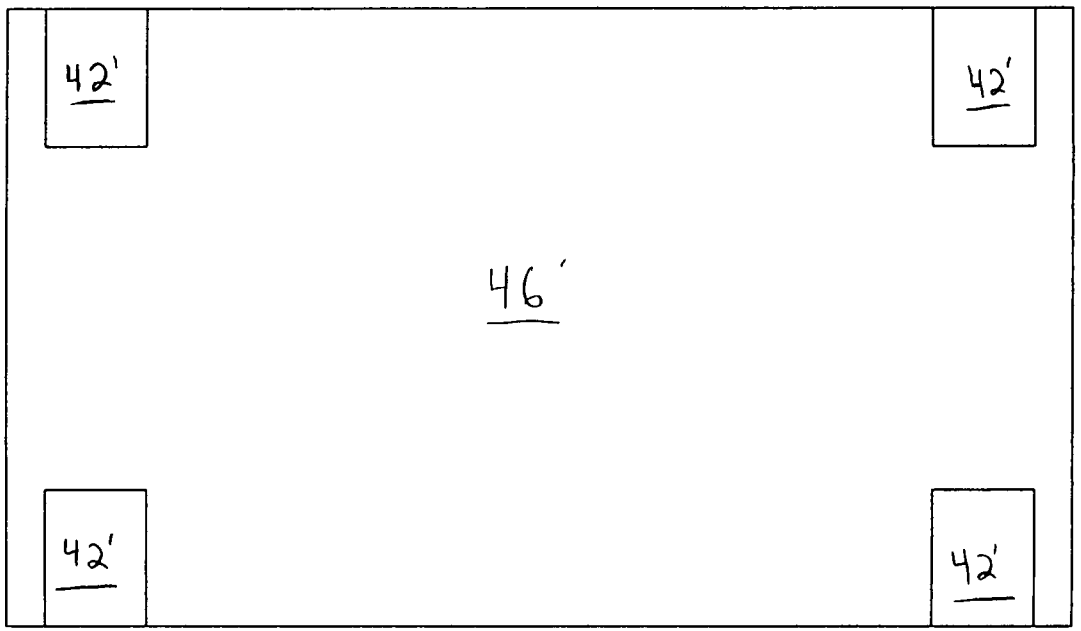
FIG. 5*a* is a schematic representation of a bottom view of the overlying member in the embodiment of FIG. 5.

In addition, referring now to FIGS. 5 and 5*a*, the lower surface 46' of the overlying member 40' may include at least one or a plurality of cooperatively structured and disposed tabs 42' thereon. As such, tabs 42' of the overlying member 40' may be cooperatively disposed, for example, insertable within the receiving slots 12' of the mounting devices 20'. More in particular, the tabs 42' of the overlying member 40' may be slidingly engageable with the cooperatively disposed receiving slots 12' of the mounting devices 20'. However, the tabs 42' may be cooperatively engaged with the receiving slots 12' in a plurality of manners including, but not limited to, a snap fit.

Figure 6:
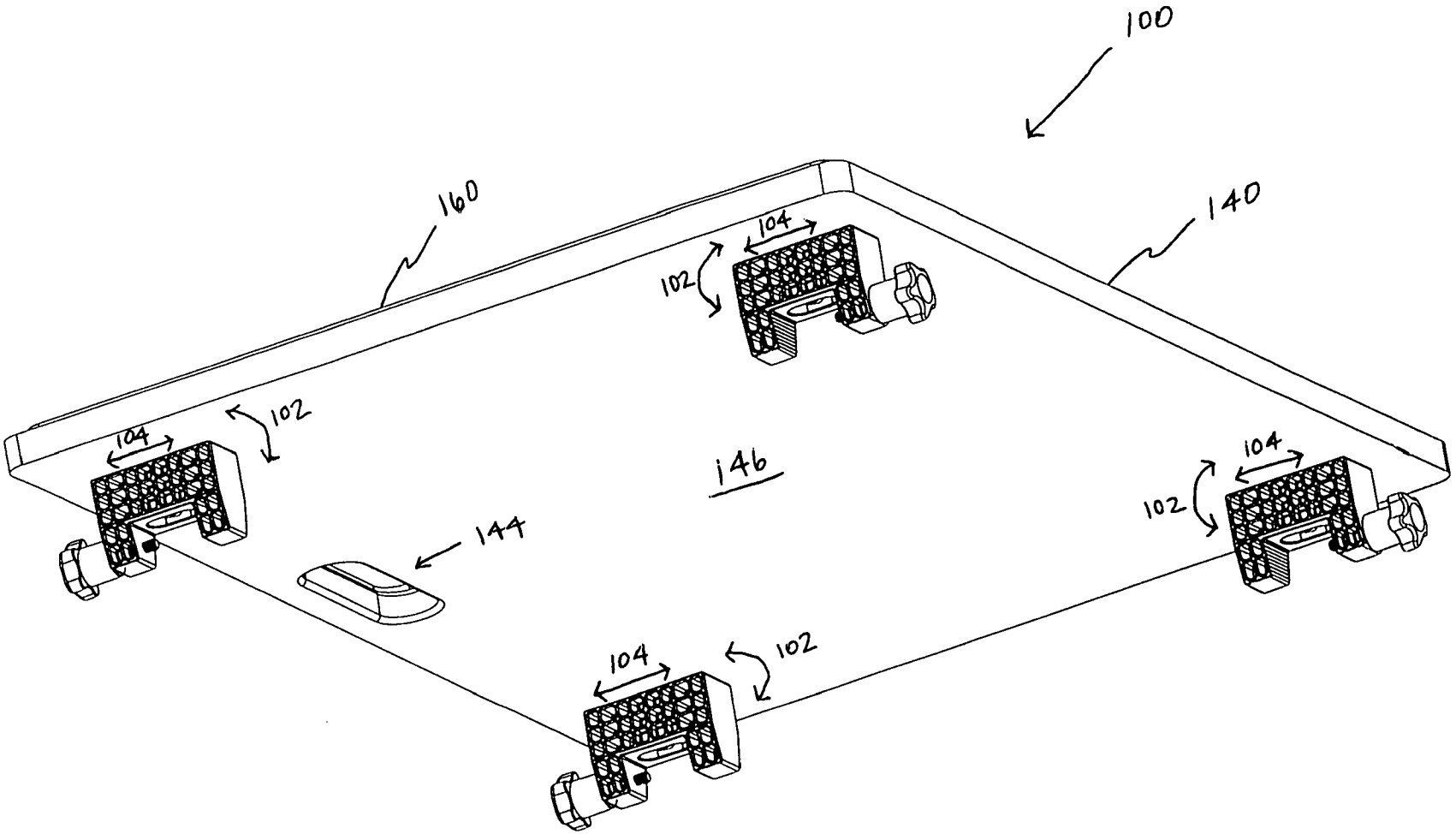
FIG. 6 is a schematic representation of yet another embodiment of the support assembly of the present invention.
Figure 6A:
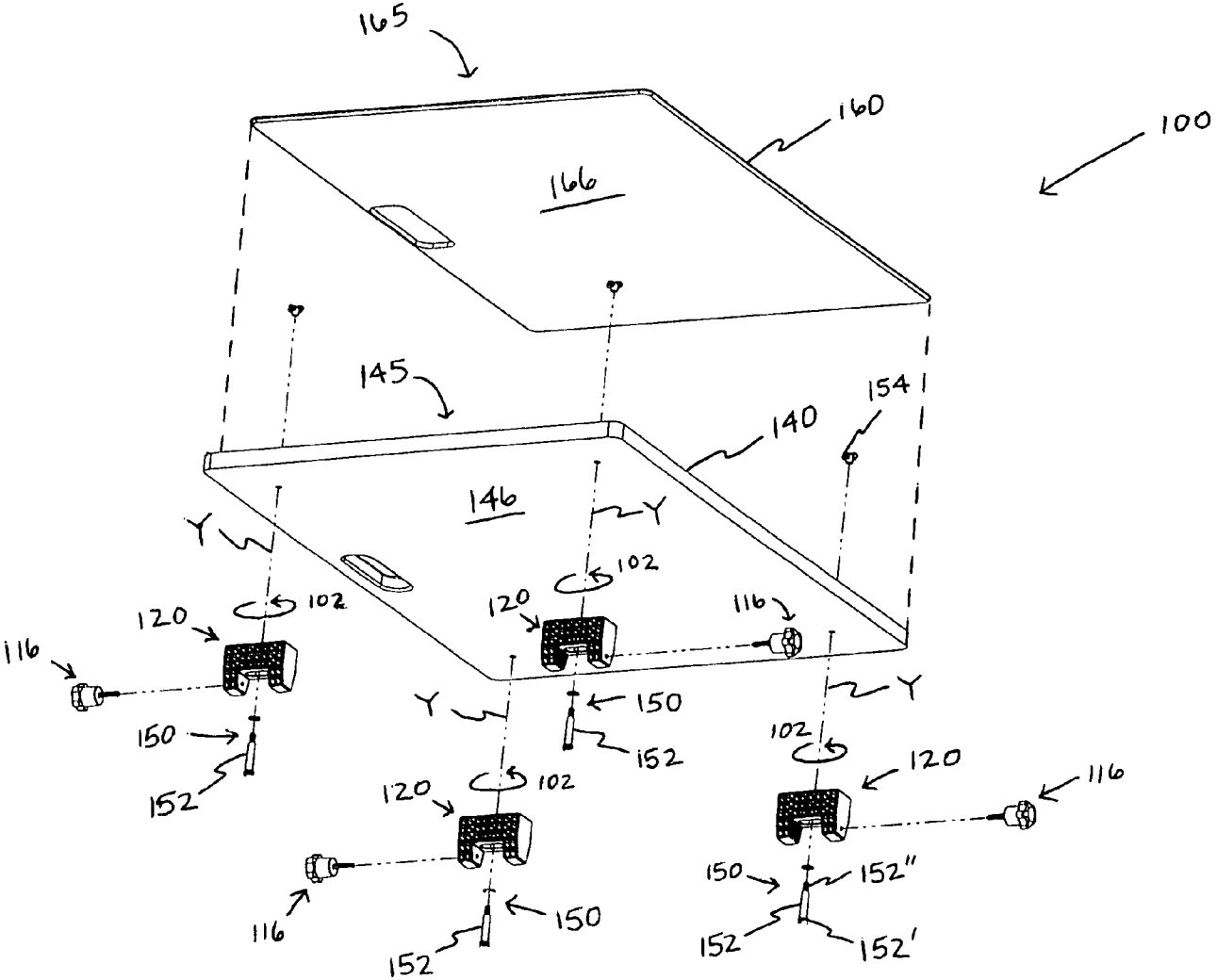
FIG. 6*a* is a schematic representation of an exploded view of the embodiment of the support assembly illustrated in FIG. 6.

Yet another embodiment of the support and/or storage assembly of the present invention is illustrated in FIGS. 6 and 6*a*, and generally indicated as 100. In particular, as best shown in the exploded view of FIG. 6*a*, the present invention includes an anchoring assembly 150 structured to connect the mounting device 120 to the panel member 140. The anchoring assembly 150 of at least one embodiment includes a securing member 152, such as, for example, a screw or bolt, and a locking nut 154. The locking nut 154 is structured to be secured to, disposed on, or embedded within, the panel member 140. Particularly, as shown in FIG. 6*a*, the locking nut 154 in at least one embodiment is structured to be disposed at or near an upper surface 145 of the panel member 140. Moreover, the securing member 152 of the various embodiments includes a preferably enlarged head or proximal end 152', a distal end 152", and a shaft 153. The proximal end 152' may be enlarged, i.e., having a larger circumference, width, or configuration than the shaft 153, the significance of which will become apparent from the discussion below. The distal end 152" is structured to engage or otherwise secure to the locking nut 154, whereas the proximal end 152' is structured to contact or otherwise hold the corresponding mounting device 120 in place against the panel member 140. Accordingly, as will also be explained below, the securing member(s) 152 and the mounting device(s) 120 are cooperatively structured such that the mounting device 120 may be disposable in a plurality of orientations relative to the panel member 140. Specifically, in at least one embodiment, the securing member 152 may be disposable into and out of a secured and an unsecured position by, for example, tightening and loosening the securing member 152. The securing member 152 may be manipulated by hand or with a tool, such as, for example, a screw driver or other like device. In at least one embodiment, however, the securing member 152 includes a spring-loaded mechanism such that the securing device 152 may be disposable into and out of a secured and unsecured position by way of compressing and/or releasing the securing member 152.

Either way, in at least one embodiment, disposing the securing member 152 in the unsecured or loosened position facilitates orienting the mounting device 120 in any one of a plurality of positions. In particular, as shown by arrows 102, the mounting device(s) 120 may rotate about axis Y and/or the securing member(s) 152. Further, as shown by arrows 104 in FIG. 6, the cooperative structuring of the securing member(s) 152 and the mounting device(s) 120 facilitate a sliding movement of the mounting device(s) 120 along the lower surface 146 of the panel member 140. Moreover, in at least one embodiment of the present invention, disposing the securing member 152 in the secured or tightened position will serve to dispose the corresponding mounting device 120 in a fixed or otherwise tight relation relative to the panel member 140.

Still referring to FIGS. 6 and 6*a*, at least one embodiment of the present invention includes one or more covering devices 160 disposable in an overlying, confronting relation to the upper surface 145 of the panel member 140. Again, it is noted however, that the support assembly 100 of the present invention may be disposed on any base structure having any angular orientation relative to the floor. Accordingly, in the event the support assembly 100 is mounted on a wall, ceiling, or any other orientation, the upper surface 145 of the panel member 140 will remain as the outer facing surface of the panel member 140 relative to the base structure, such as the wall or ceiling.

In a preferred embodiment, the lower surface 166 of the covering device 160 is removably or interchangeably disposable in an overlying relation to the panel member 140. Specifically, the covering device 160 may be removably connected to the panel member 140 in any one of a plurality of manners, including, but not limited to hook and loop type fasteners, clips, snaps, etc. It is also contemplated that the covering device 160 merely overlies the panel member 140 without any additional securing mechanisms. Further, the covering device 160 of one embodiment is structured to facilitate an individual kneeling, crawling, sitting, or standing on the upper surface 145 thereof. Similar to the upper surface 165 of the panel member 140, the upper surface 165 of the covering device 160 is the outer facing surface thereof relative to the base structure, regardless of what angular orientation the support assembly 100 is mounted relative to the floor or ground.

Further, in at least one embodiment, the covering device 160, and in particular, the upper surface 165 thereof, may be padded, cushioned, or otherwise include a soft material structured to facilitate the practice of the present invention in the intended fashion. In addition, in yet another embodiment, it is contemplated that the upper surface 165 of the covering device 160 includes compartments or partitions which are structured to facilitate the organization and/or disposition of various objects stored thereon.

Figure 6B:
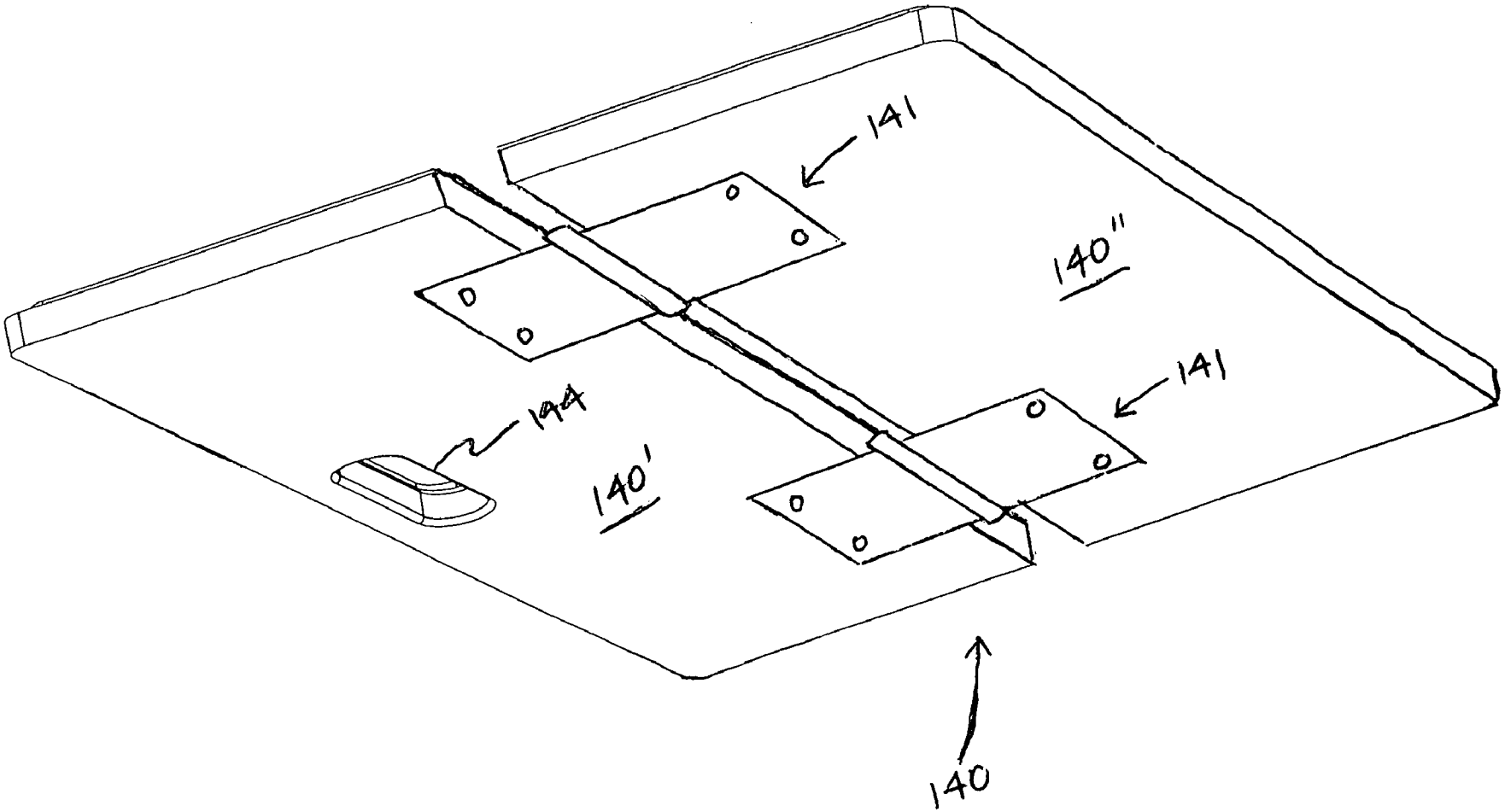
FIG. 6*b* is a schematic representation of at least one embodiment of the panel member of the support assembly of the present invention.

As shown in FIG. 6*b*, the panel member 140 of the present invention may include a plurality of segments 140' and 140" movably disposable relative to one another. In particular, in at least one embodiment, the panel member 140 includes one or more pivoting mechanisms 141, such as hinges structured to dispose the various segments 140' and 140" into and out of an operative and collapsed position. Although not shown in the Figures, the covering device 160 of the various embodiments of the present invention may also include one or more segments similarly disposed in a movable and/or collapsible relation relative to one another. In addition, the panel member 140 and/or covering device 160 may include a handle 144 or other gripping mechanism structured to facilitate an individual moving, carrying, shifting, or orienting the support assembly 100 of the present invention.

Figure 7:
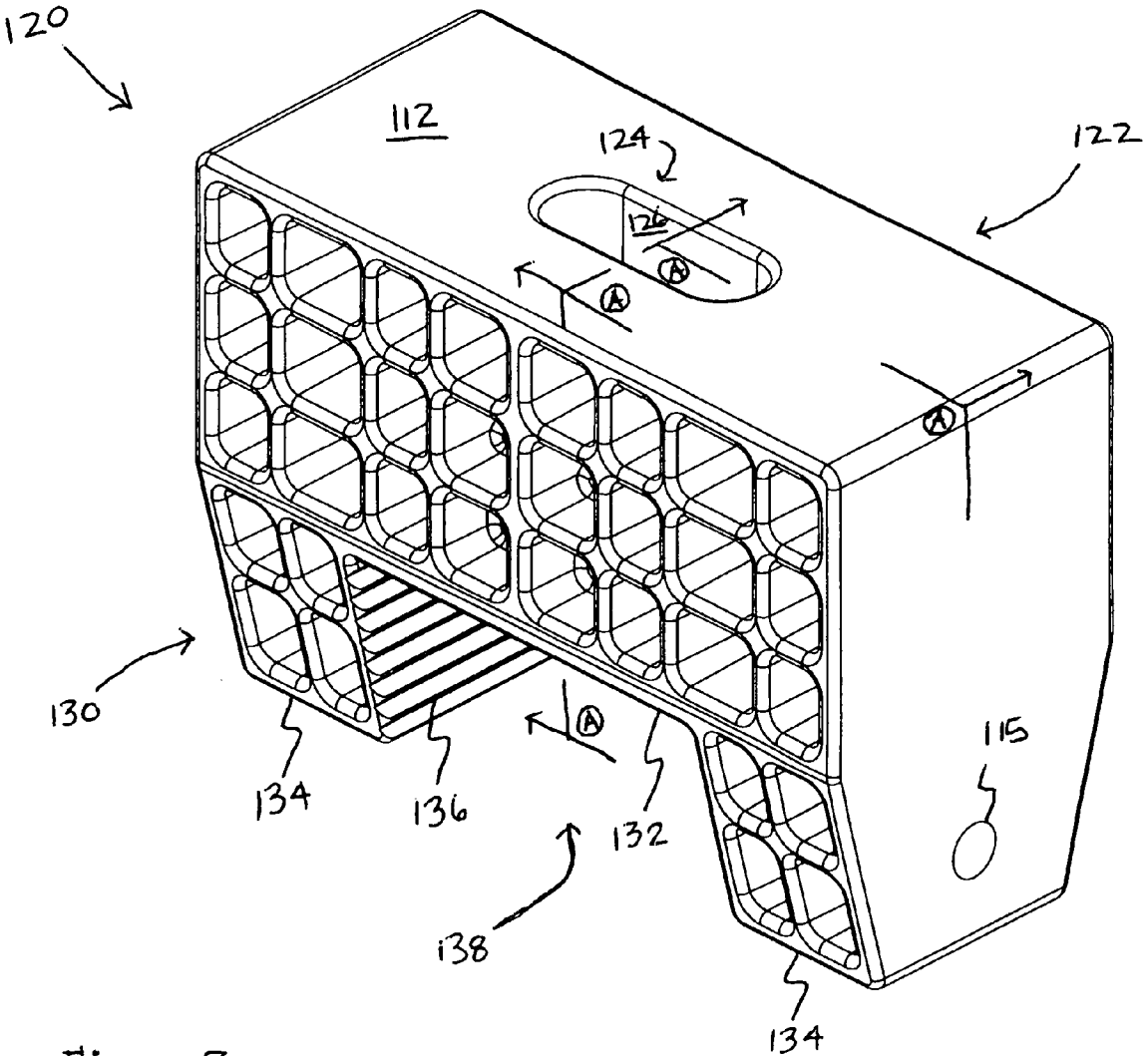
FIG. 7 is a schematic representation of the mounting assembly in the embodiment of the support assembly illustrated in FIG. 6.

Referring now to FIG. 7, the mounting device 120 of at least one embodiment of the present invention includes a facing member 112 disposed at or near an upper portion 122. In particular, the facing member 112 is preferably disposable in a confronting relation with the lower surface 146 of the panel member 140, as shown in FIGS. 6 and 6*a*. The lower surface 146 of the panel member 140 is defined as the oppositely disposed surface relative to the upper surface 145. Further, the lower surface 146 of the panel member 140 may be further or instead defined as the surface of the panel member 140 facing the base structure 50 on which the support assembly 100 is mounted, such as the truss members in an attic, the floor, wall, and/or ceiling. Moreover, as illustrated in FIG. 7, the mounting device(s) 120 include an attachment mechanism 130. Similar to at least one of the embodiments described in detail above, the attachment mechanism 130 is connectable to the base structure 50. In particular, the attachment mechanism 130 includes at least one, but preferably two spaced apart, outwardly extending members 134. The outwardly extending members 134 are connected in a spaced apart relation by member 132, thereby defining a channel 138 therebetween.

Additionally, as shown in FIG. 7, at least one of the outwardly extending members 134 includes an irregular surface configuration, which may at least partially be defined by teeth 136. The teeth 136, or other irregular surface configuration, may operate to facilitate the gripping engagement between the attachment mechanism 130 and the base structure.

Figure 7A:
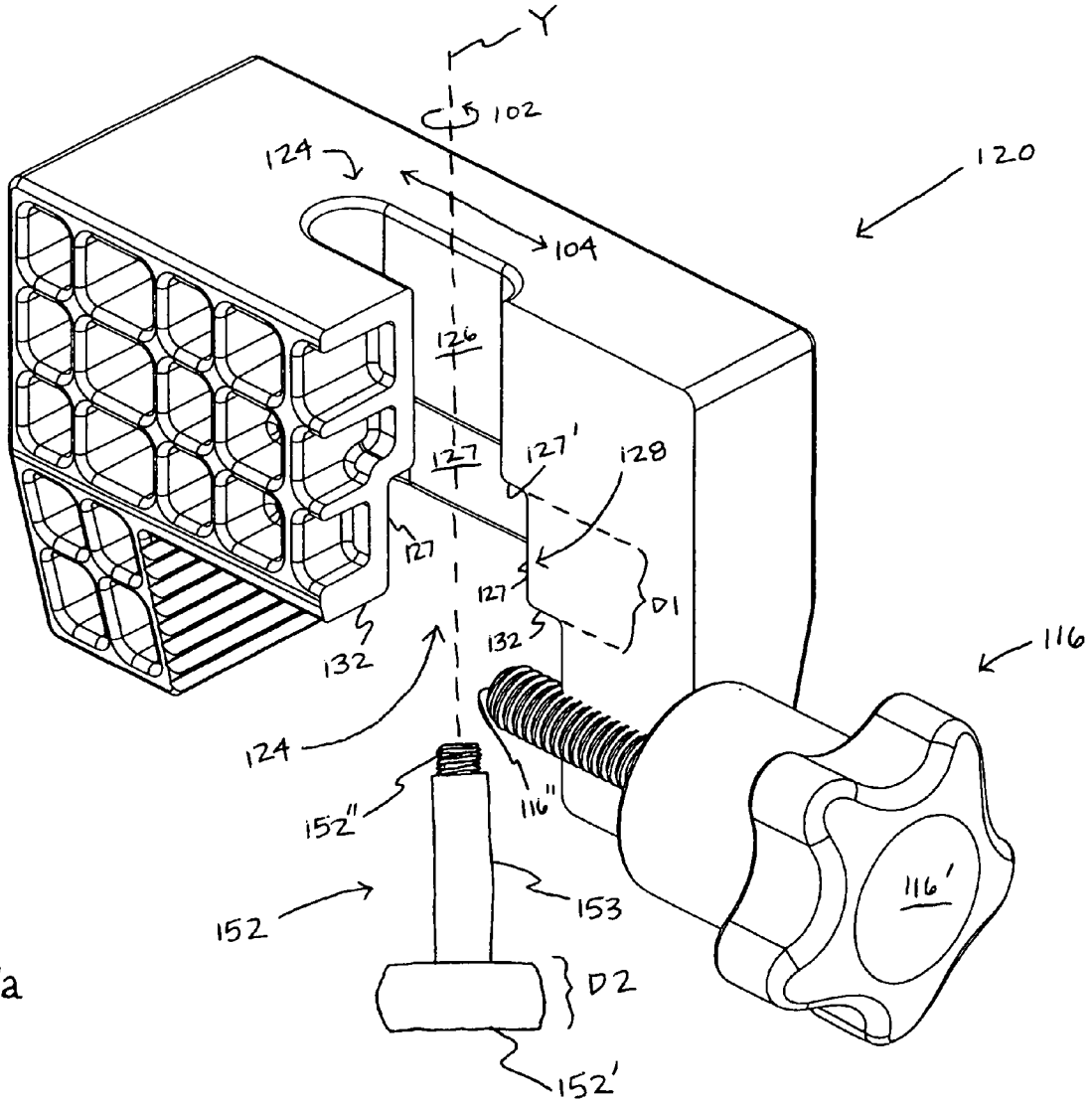
FIG. 7*a* is a schematic representation of a partial cut-away view of the mounting device illustrated in FIG. 7.

Referring now to FIG. 7*a*, which illustrates a partial cutaway view of the mounting device 120 shown in FIG. 7, similar to at least one of the embodiments discussed in detail above, the present invention includes a tightening assembly, such as fastener 116. In particular, the fastener 116 includes a proximal end 116' and a distal end 116". The proximal end 116' may be manipulated, i.e., tightened and/or loosened, in any one of a plurality of manners. Specifically, in a preferred embodiment, the fastener 116, and in particular, the proximal end 116' thereof, may be twisted or otherwise rotated by hand; however, tools may be utilized if desired or needed. Further, in a preferred embodiment, the distal end 116" of the fastener 116 is structured to engage the surface of the base structure by way of pressure and/or friction so as to connect the attachment mechanism 130 of the mounting device 120 thereto. It is also contemplated that, in yet another embodiment of the present invention, the fastener 116 includes a spring loaded mechanism that may be manipulated, for example, tightened and loosened, by compressing and/or releasing the fastener 116 or various portions thereof.

Still referring to FIG. 7*a*, the mounting device 120 includes interior walls 126 and recessed interior walls 127 structured and disposed to at least partially define an opening 124. In particular, the mounting device 120 and/or the opening 124 thereof includes a recessed portion 128 at least partially defined by the recessed interior walls 127 and a recessed ledge 127'. Accordingly, as shown in FIG. 7*a*, the securing member 152 is structured to be disposed along axis Y and pass at least partially through, or otherwise be inserted within the opening 124, at least until an enlarged head or proximal end 152' of the securing member 152 engages or otherwise contacts the recessed ledge 127'. Furthermore, at least while the securing member 152 is disposed in a secured position, in a preferred embodiment of the present invention, the recessed portion 128 is structured to completely house the proximal end 152' of the securing member 152 therein. In particular, the distance between recessed ledge 127' and the peripheral surface of member 132, represented as D1, is greater than or equal to the depth of the head or proximal end 152' of the securing member 152, represented as D2.

Additionally, as briefly described above and illustrated by arrows 102 and 104, the cooperative structuring of the mounting device(s) 120, and in particular the opening 124, the recessed portion 128, and the securing member 152, facilitates the positioning of the mounting device(s) in any one of a plurality of orientations. Specifically, as represented by arrow 104, the mounting device 120 may slide back-and-forth, at least until the interior wall(s) 126 or the recessed interior wall(s) 127 contact or confront the securing member 152. Furthermore, as described above, the mounting device 120 is structured to rotate about axis Y, represented by arrow 102, into a plurality of orientations. As such, the support assembly 100 of the present invention may be positioned or oriented to fit or otherwise be disposed on a plurality of spaced apart truss members, beams, or other base structures.

Figure 8:
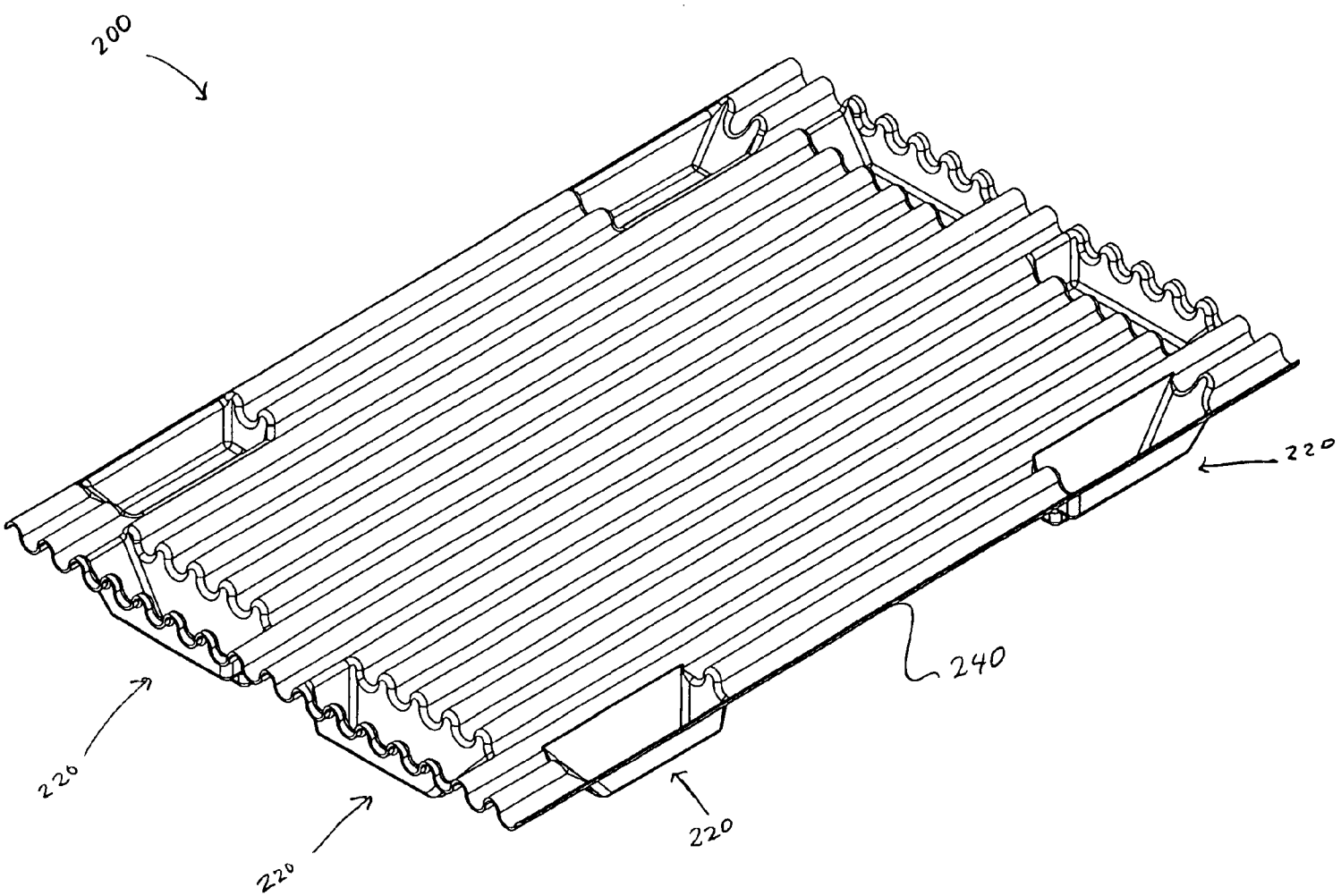
FIG. 8 is a perspective view of at least one embodiment of the storage assembly disclosed in the present specification.

Referring now to FIG. 8, the present invention further includes a storage assembly, generally indicated as 200, comprising a platform 240 and at least one mounting device 220. The platform 240, of at least one embodiment, is similar in structure and function to at least one embodiment of the overlying and/or panel member 40, 140 respectively, described above. In particular, the platform 240 is structured to facilitate or support disposition of virtually any item, structure, or device thereon, including, but not limited to box(es), bin(s), receptacle(s), etc. At least one embodiment of the platform 240 includes a corrugated, grooved, or creased configuration, however, the platform 240 may be smooth, flat, or any other configuration structured to facilitate the practice of the present invention in the intended manner. In addition, the mounting device(s) 220 may be integrally affixed to the platform 240, for example, via glue, screw(s), and/or nail(s). However, in at least one embodiment, the platform 240 and the mounting device(s) 220 are constructed via a single mold or other manufacturing process. Of course, as above, the mounting device(s) 220 may be removably connected or attached to the platform 240 in virtually any manner, including, but not limited to the tab(s) 12, receiving slot(s) 42, and/or anchoring assembly 150 described above.

Figure 9:
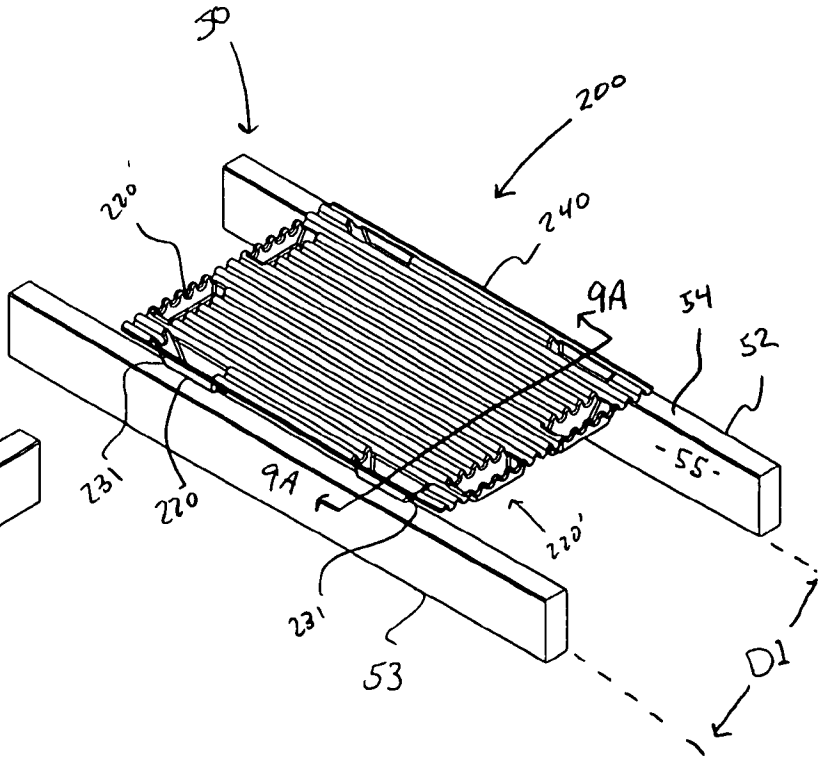
FIG. 9 is a perspective view of the embodiment illustrated in FIG. 8 disposed in an engaging relation to a base having adjacent beams disposed in at least one supported orientation.

As illustrated in FIG. 9, the storage assembly 200 of at least one embodiment of the present invention is structured to be supported on a base 50, wherein the base 50 includes a plurality of spaced apart beams 52, 53. The storage assembly 200 of the present invention, however, need not be disposed on beams 52, 53. Rather, the storage assembly 200 may be disposed on virtually any base 50 including a flat or level surface.

Further, the mounting device(s) 220 of at least one embodiment is structured and disposed to removably support the platform 240 in a predetermined spaced relation to the base 50. Accordingly, and similar to at least one of the embodiments described in detail above, the platform 240 may be disposed a predetermined distance from the base 50 to allow or otherwise facilitate the passage of wires, pipes, or other objects there between.

Figure 9B:
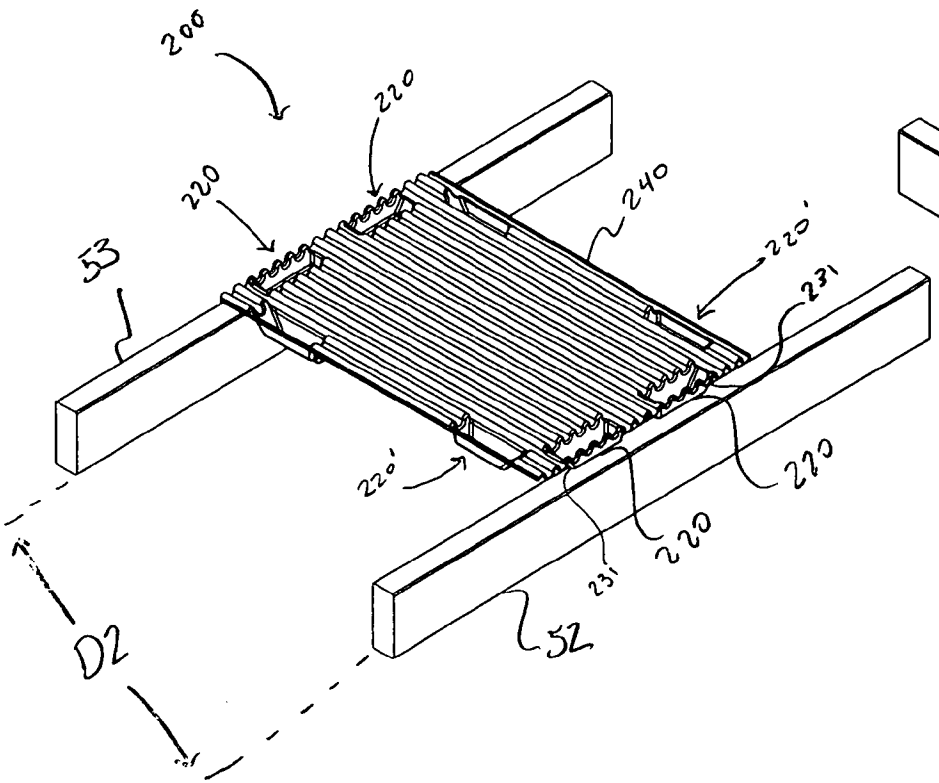
FIG. 9B is another perspective view of the embodiment of the storage assembly represented in claim 9 disposed on a base having adjacent beams disposed in at least one supported orientation.
Figure 9A:
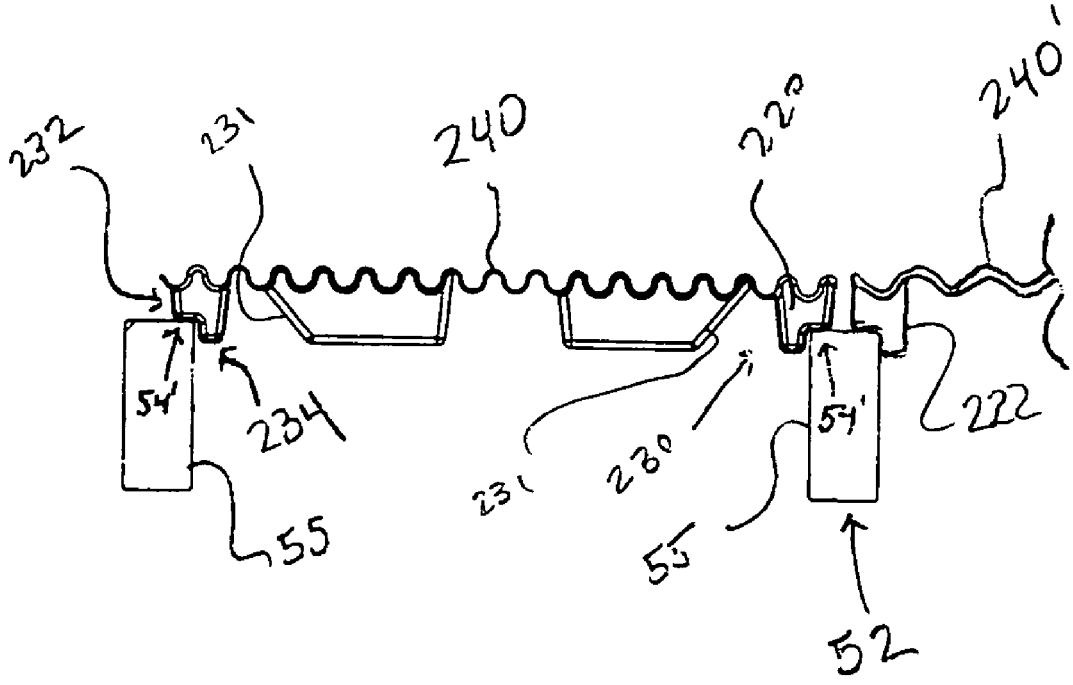
FIG. 9A is a partial cut away view of the embodiment of the storage assembly illustrated in FIG. 9.

In at least one embodiment of the present invention, the mounting device(s) 220 are attached to the platform 240 and include an attachment mechanism 230 removably engaging the base 50. In particular, the attachment mechanism 230 includes a support portion 232 disposed in a confronting and/or supporting relation to a top portion 54 of a corresponding beam 52, 53 of the base 50. Additionally, the mounting device(s) 220, of at least one embodiment, includes a stabilizing portion 234 extending outwardly from the support portion 232 and disposed in a facing relation to a side 55 of the corresponding beam 52, 53. The stabilizing portion 234 illustrated in FIG. 9A is similar in structure and function to the outwardly extending members 34 and 134 described above and illustrated in the embodiments shown in FIGS. 1 and 7, respectively. In particular, FIG. 9A is a cross-sectional view of line 9A-9A of the embodiment illustrated in FIG. 9. Moreover, the support and stabilizing portions 232, 234, respectively, are structured to maintain, secure, or support the attachment mechanism 230 engaging the base 50, such as beams 52, 53 such that the mounting devices 220 are not easily or inadvertently slipped off the base 50.

As best seen in the embodiment illustrated in FIG. 9A, the support and stabilizing portions 232 and 234, respectively, are cooperatively disposed to define a substantially "L" shaped configuration, which is disposable in an overlying relation to an inner longitudinal edge 54' of the corresponding beam 52, 53 of the base 50. Accordingly, because the mounting device (s) of at least one embodiment is not disposed over the entire top surface 54 of the beams 52, 53, but rather an inner longitudinal edge 54' thereof, as can bee seen in FIG. 9A, another mounting device 222 of similar structure and function, which may be attached to an adjacent platform 240', may be disposed in a confronting, supported relation to a common beam 52.

In addition, the mounting device(s) 220 and/or attachment mechanism(s) 230 thereof may include an at least partially sloped and/or angled configuration on a leading edge 231 thereof. Accordingly, an individual may slide the platform 240 and/or mounting device(s) 220 across the base 50 and in the event an obstacle such as, for example, a wire, pipe, cross beam, etc. is in the way, the sloped and/or angled configuration on the leading edge 231 is structured to navigate or move over the obstacle with minimal force.

Figure 10A:
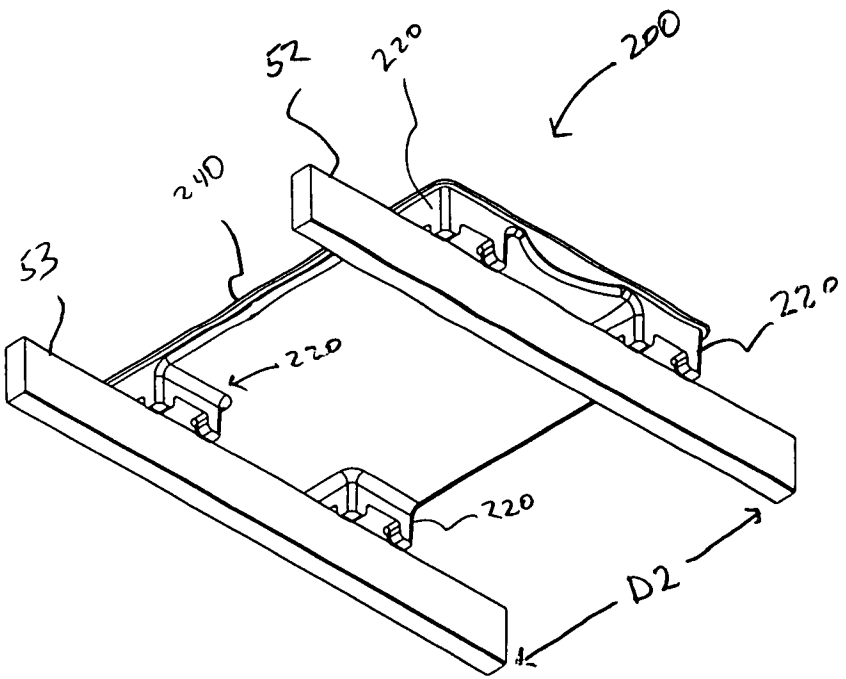
FIGS. 10 and 10A are perspective views of another embodiment of the support assembly disclosed in accordance with the present specification.
Figure 10:
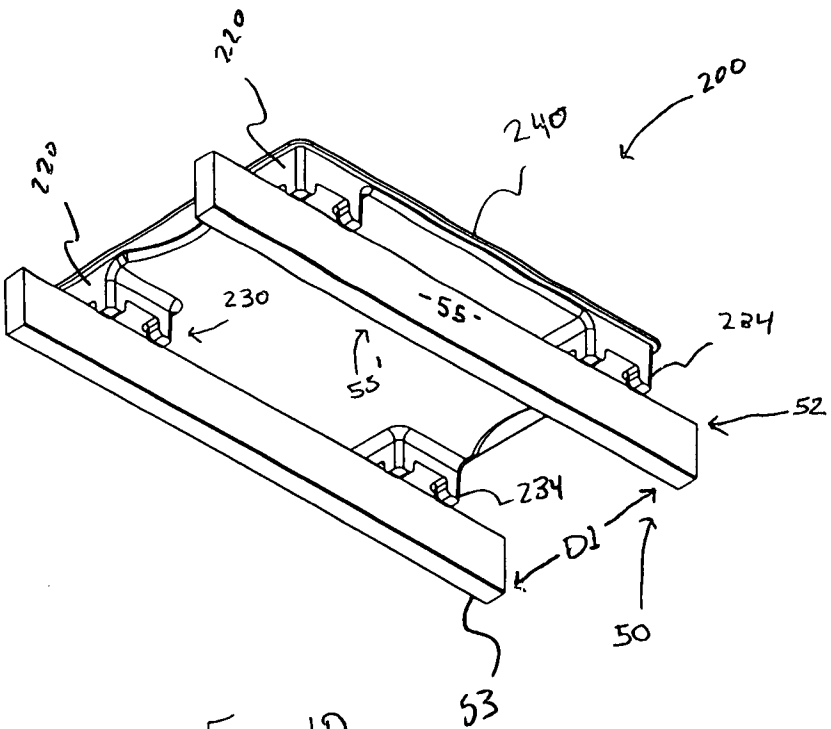
Figure 11:
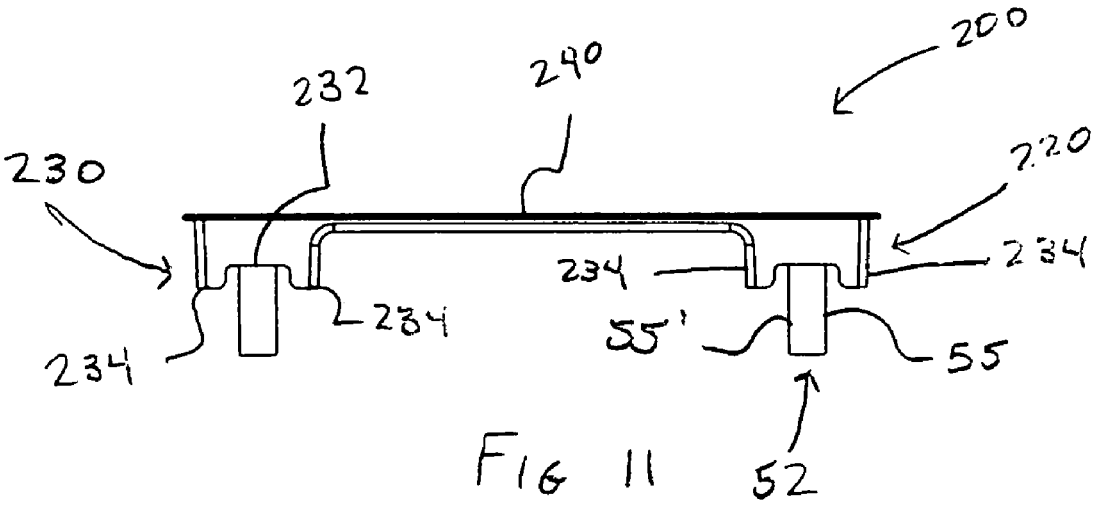
FIG. 11 is a side elevation view of the embodiment of the support assembly illustrated in FIGS. 10 and 10A.

In yet another embodiment of the present invention, as illustrated in FIGS. 10 and 11, the attachment mechanism 230 includes at least two stabilizing portions 234 disposed in a spaced apart relation to one another and disposable in a facing relation to oppositely disposed sides 55, 55' of the corresponding beam 52 of the base 50. Accordingly, the support portion 232 of at least one embodiment is structured and disposed to extend substantially across the top surface 54 of the corresponding beam 52. Furthermore, although not illustrated, similar to at least one of the embodiments described above, at least one of the stabilizing portions 234 of the present invention may include an irregular surface configuration, such as teeth, to provide gripping to the base 50 and/or corresponding beam(s) 52, 53.

In addition, at least one embodiment of the present invention includes at least four mounting devices 220 attached to the platform 240, wherein the mounting devices 220 are cooperatively disposed to removably support the platform 240 on two adjacent beams 52, 53 disposed in either of at least two supported orientations. The at least two supported orientations of the beams 52, 53 are distinguishable by a variable spacing or distance D1, D2 between the two adjacent beams 52, 53. For instance, referring now to FIGS. 9 and 9B, the adjacent beams 52, 53 may be disposed in a spaced apart relation measured by distances D1 and D2. For exemplary purposes only, and as described above, it is common for beams 52, 53 in an attic or other like location to be disposed in spaced apart distances measured at sixteen (16) and/or twenty-four (24) inches on center. Of course, however, the adjacent beams 52, 53 or other bases 50 may be disposed in virtually any spaced relation from one another and not merely sixteen (16) or twenty-four (24) inches on center.

In at least one embodiment, as illustrated in FIG. 9, the mounting devices 220 may removably support the platform 240 on adjacent beams 52, 53 disposed in at least one supported orientation having a spaced apart distance D1. As illustrated in FIG. 9B, at least two of the mounting devices 220 are attached to the platform 240 and disposed thereon to removably support the platform 240 on adjacent beams 52, 53 disposed in at least one other supported orientation having a spaced apart distance D2. As such, in at least one embodiment, the platform 240 may be rotated, for example ninety degrees (90°), to removably support the platform 240 on adjacent beams 52, 53 disposed in at least one of the supported orientations illustrated in FIGS. 9 and 9B. In at least one embodiment, and as illustrated in FIGS. 9 and 9B, while the platform 240 is disposed on adjacent beams 52, 53 in either of at least two supported orientations, at least one mounting device 22 attached thereto is disposed in an engaging relation with the base 50, while at least one other mounting device 220' attached to a common platform 240 is disposed in a non-operative or non-engaging relation to the base 50.

Referring to the embodiment illustrated in FIGS. 10 and 10A, the mounting devices 220 shown are also attached to the platform 240 and cooperatively disposed thereon to removably support the platform 240 on two adjacent beams 52, 53 in either of at least two supported orientations distinguishable by a variable spacing or distance D1, D2 between the two adjacent beams 52, 53. In such an embodiment, each one of the mounting devices 220 may be disposed in an engaging relation with the base 50 while the platform 240 is disposed in either one of at least two supported orientations.

At least one embodiment of the present invention further includes a plurality of walls 206 disposed in a surrounding relation to the platform 240. As such, the platform 240 and the plurality of walls 206 are cooperatively structured and disposed to define a storage receptacle 202, wherein the storage receptacle 202 includes an at least partially hollow interior compartment 208. Accordingly, the storage receptacle 202 of at least one embodiment of the present invention may be utilized for storing virtually any item, structure, or device within the at least partially hollow interior compartment 208. In addition, the storage receptacle 202, including the platform 204 and the wall(s) 206, may comprise virtually any material, including but not limited to rubber, plastic, metal, etc.

In addition, at least one embodiment of the storage assembly 200 of the present invention may, but need not, further include a covering assembly 209, such as a lid, structured and disposed to at least partially enclose the at least partially hollow interior compartment 208. The covering assembly 209 of at least one embodiment is movably and/or pivotally connected to the storage receptacle 202 or walls 206 thereof, for example, via hinges or other like pivoting structures or devices 209'. The covering assembly 209 need not however be movably or pivotally connected to the storage receptacle 202, and may instead or additionally be removably disposable thereon.

Figure 12:
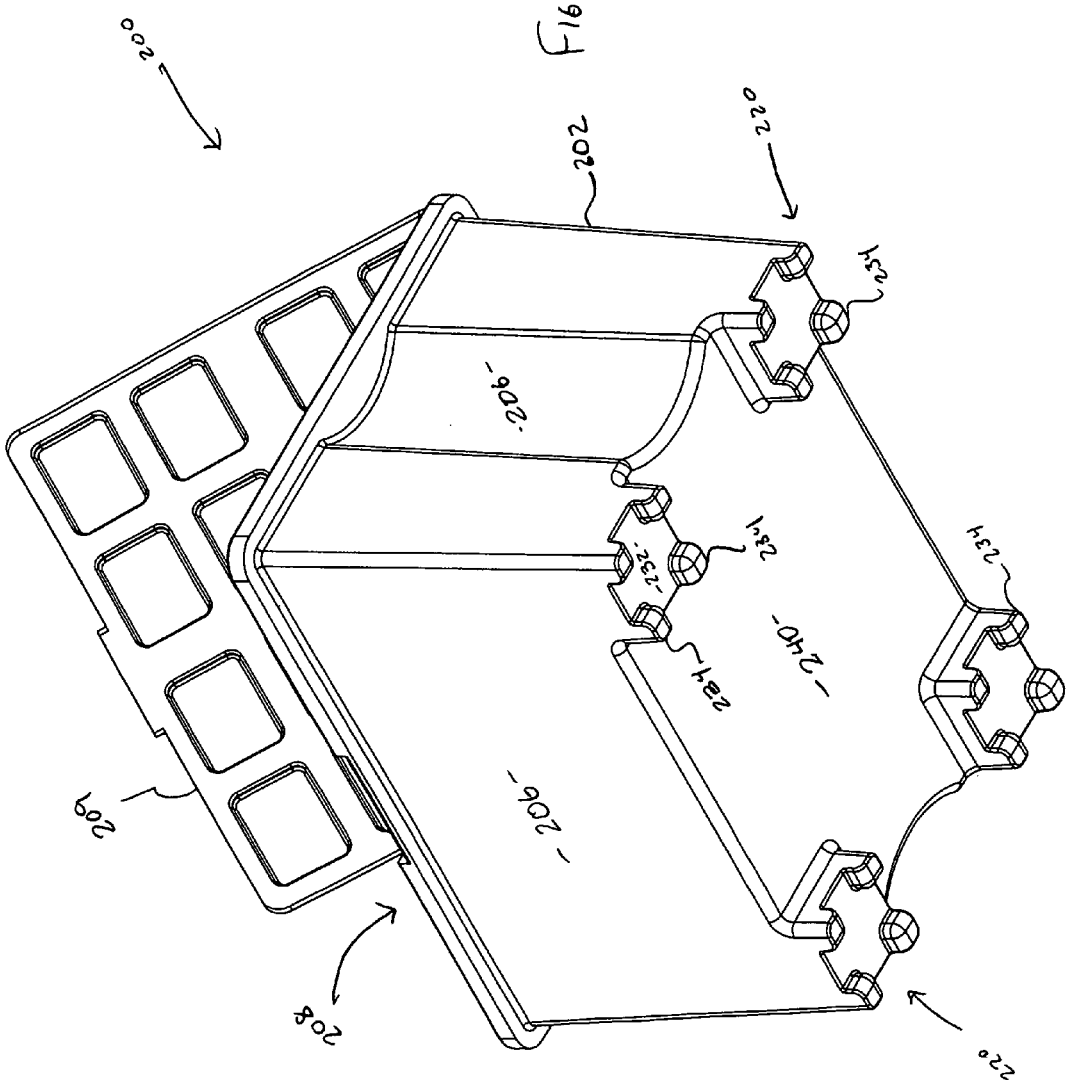
FIG. 12 is a perspective view of yet another embodiment of the storage assembly of the present specification.

As illustrated in FIG. 12, the storage assembly 200 of at least one embodiment includes at least one or a plurality of mounting devices 220 attached to the storage receptacle 202, for example at or near the platform 240. The mounting device (s) 220 may be fixedly or removably attached thereto. For instance, in at least one embodiment, the mounting device(s) 220 may be molded as one unit, however, the mounting device (s) 220 may be glued, nailed, screwed, or removably attached as explained herein.

Figure 13A:
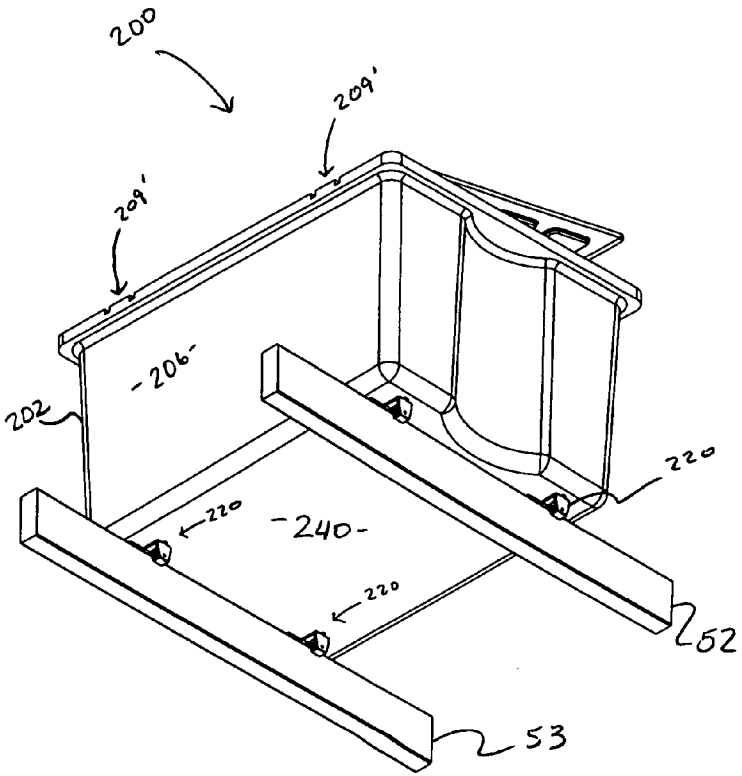
FIGS. 13 and 13A illustrate the embodiment of the storage assembly shown in FIG. 12 disposed on a base having beams disposed in one of at least two supported orientations.
Figure 13:
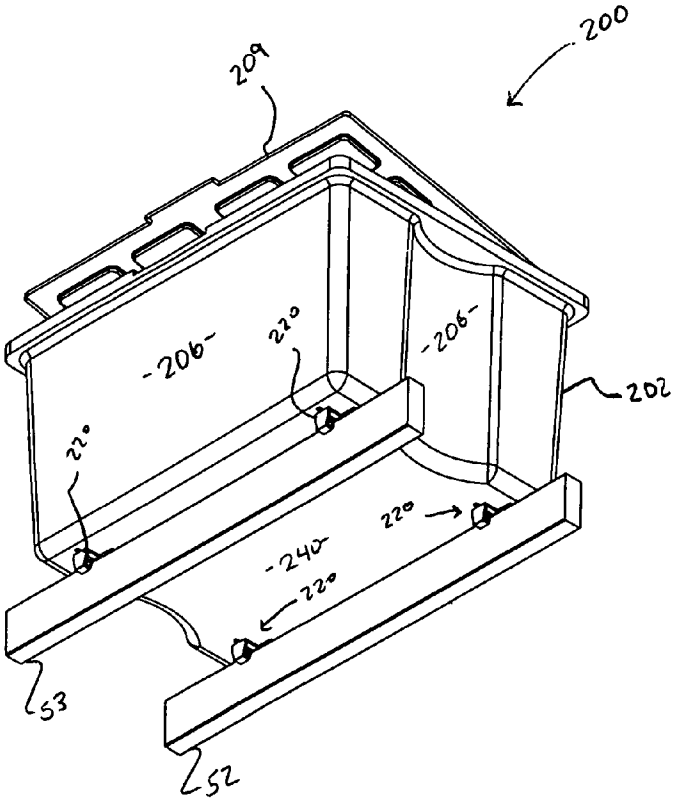
Figure 14:
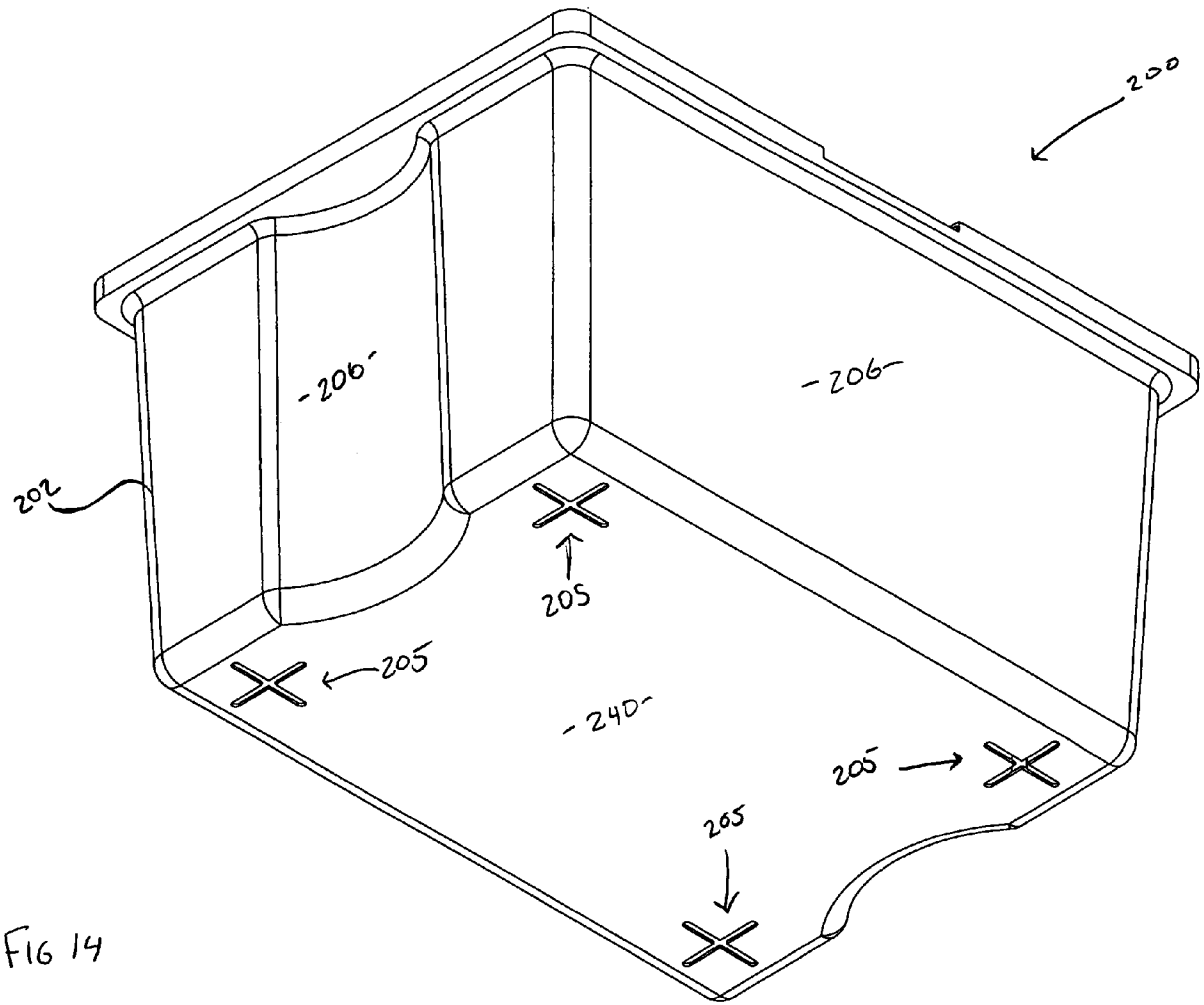
FIG. 14 is yet another embodiment of the storage assembly disclosed in accordance with the present specification.

In yet another embodiment of the storage assembly 200 of the present specification, as illustrated in FIGS. 13 and 13A, the mounting device(s) 220 are similar in structure, function, and design as the mounting device(s) 20, 120 previously described herein and as illustrated in FIGS. 1 and 7. For instance, in at least one embodiment, the mounting device(s) 220 are disposable in a plurality of orientations relative to the storage receptacle 202 and/or platform 240. Accordingly, the mounting device(s) 220 may be structured to rotate and/or slide into any one or more of a plurality of orientations or positions via receiving member(s) 205, illustrated in FIG. 14. This allows the mounting device(s) 220 of at least one embodiment of the present invention to removably support the storage receptacle 202 and/or platform 240 on two adjacent beams 52, 53 in either of at least two supported orientations. As above, the at least two supported orientations are distinguishable by a variable spacing between the two adjacent beams 52, 53 as described above.

As such, the one or more receiving members 205 of at least one embodiment are cooperatively structured and disposed to receive the mounting device(s) 220 therein. The receiving member(s) 205 of at least one embodiment are cooperatively structured to facilitate sliding and/or rotating of the mounting device(s) 220 into an operative orientation. In addition, similar to the embodiment illustrated in FIGS. 6 and 7, and described above, the mounting device(s) 220 may include an anchoring assembly 150 structured to attach the mounting device(s) 220 to the storage receptacle 202. The anchoring assembly 150 may include, for example, a screw, bolt, or other securing member 152 structured to facilitate the practice of the present invention in the intended manner.

Figure 15:
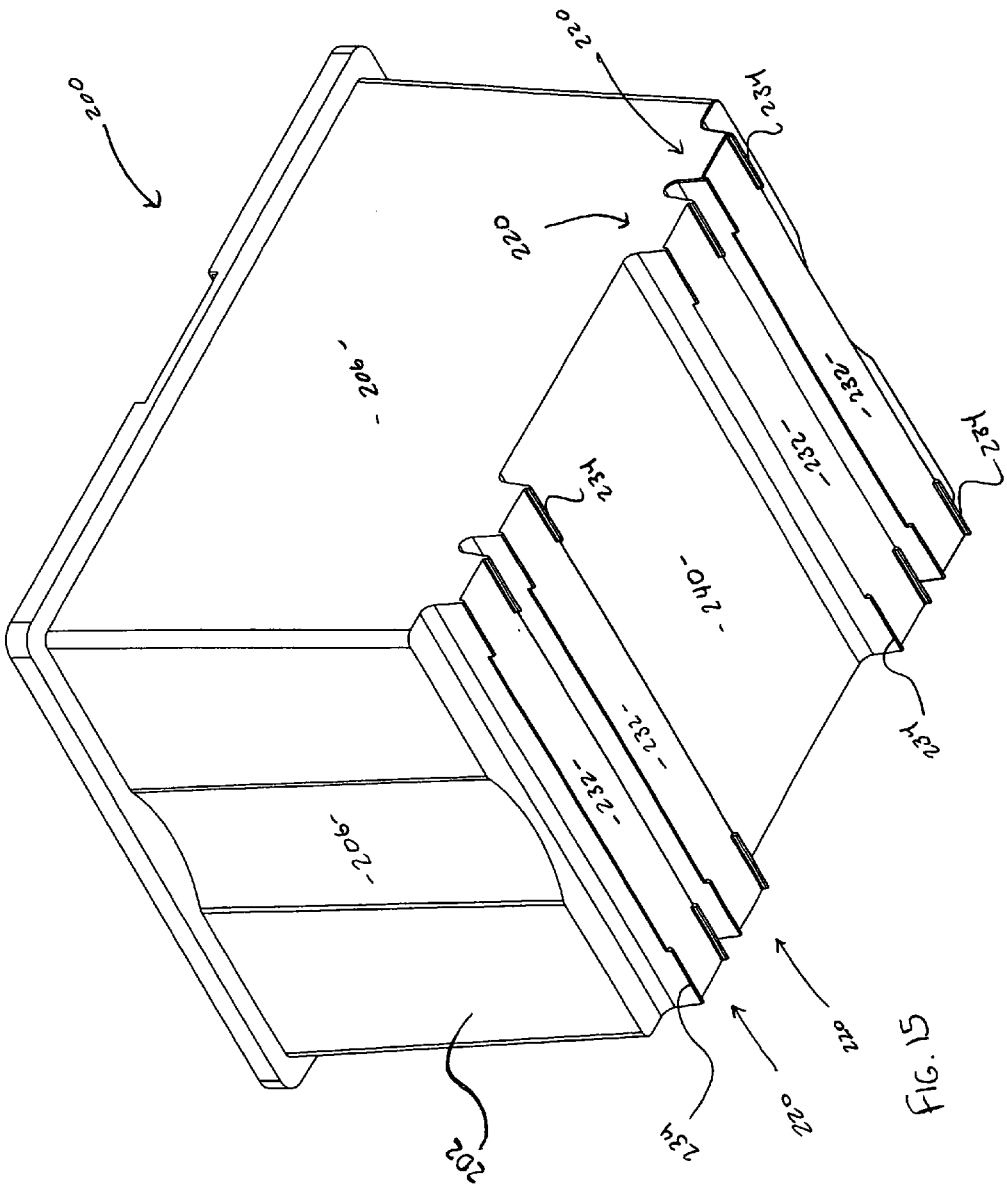
FIG. 15 is at least one embodiment of the storage assembly including mounting devices comprising an elongate configuration.
Figure 16A:
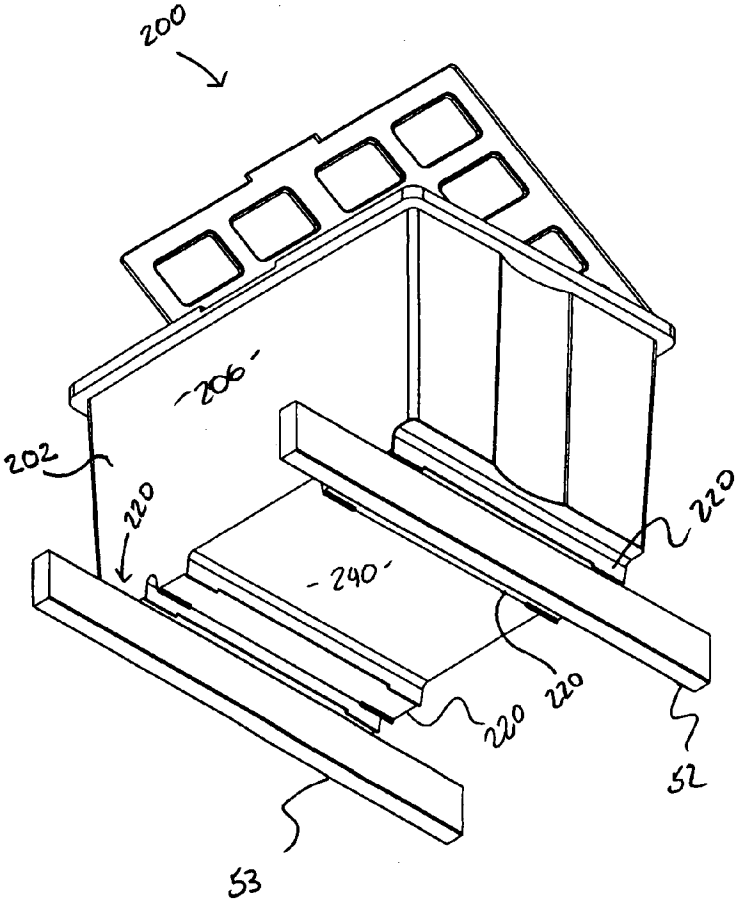
FIGS. 16 and 16A are perspective views of the embodiment illustrated in FIG. 15 engaging a base having beams disposed in one of at least two supported orientation.
Figure 16:
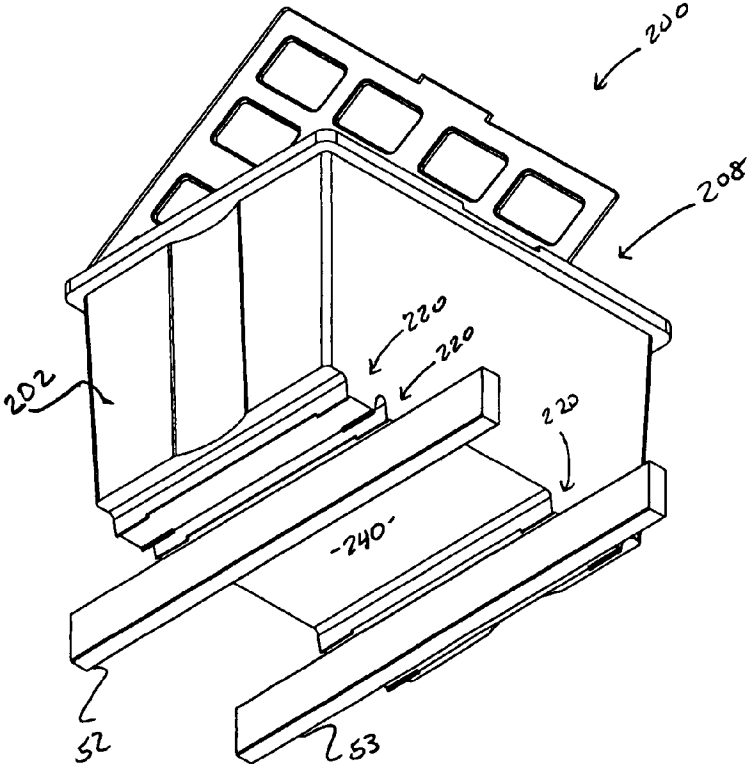

Referring now to FIGS. 15, 16, and 16A, in yet another embodiment, the mounting device(s) 220 include an elongate configuration disposed substantially across a portion of the platform 240. Further, as illustrated, the stabilizing portion(s) 234 may be disposed at or near an end of the mounting device(s) 220. However, it is contemplated that the stabilizing portion(s) 234 are structured to extend along the entire length of the mounting device(s) 220.

In at least one embodiment, and as shown in FIGS. 15, 16, and 16A, the storage assembly 200 includes a plurality of elongated mounting device(s) 220 disposed in a substantially parallel relation to one another. This configuration allows the storage assembly 200, and in particular, the mounting device (s) 220 to removably support the storage receptacle 202 and/or platform 240 on two adjacent beams 52, 53 disposed in either of at least two supported orientations, or otherwise disposed in either of at least two spaced apart distances.

Figure 17:
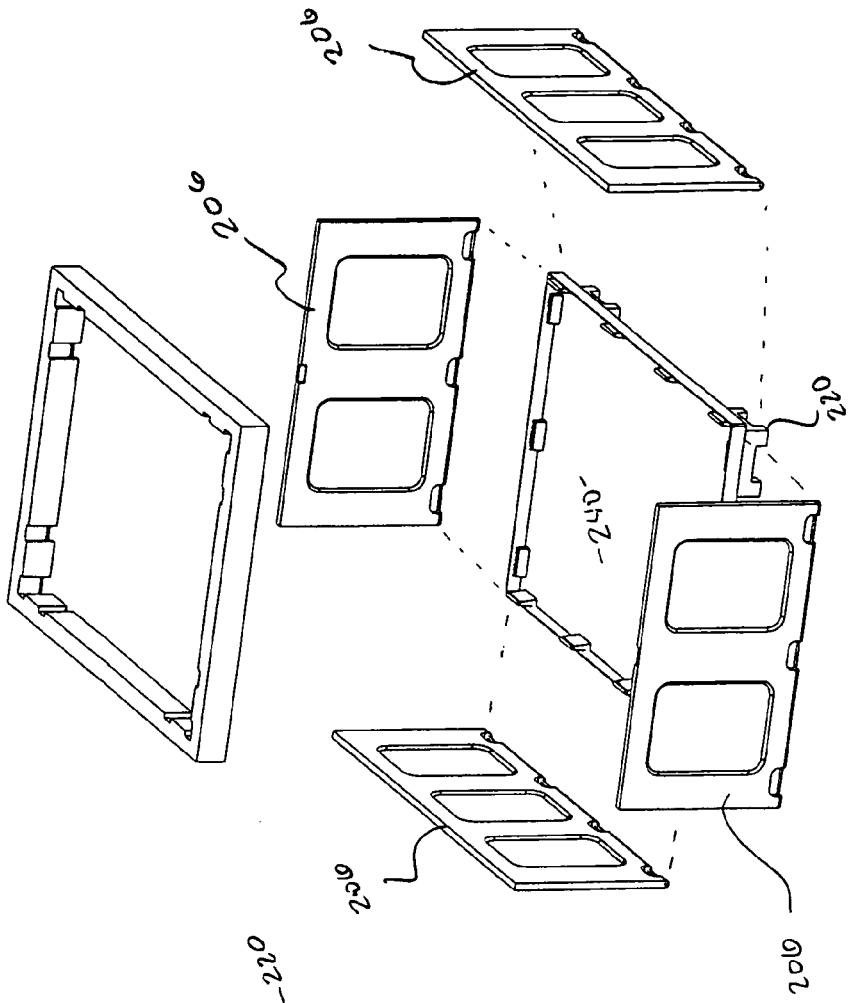
FIG. 17 is an exploded view of yet another embodiment of the storage assembly of the present specification.
Figure 17A:
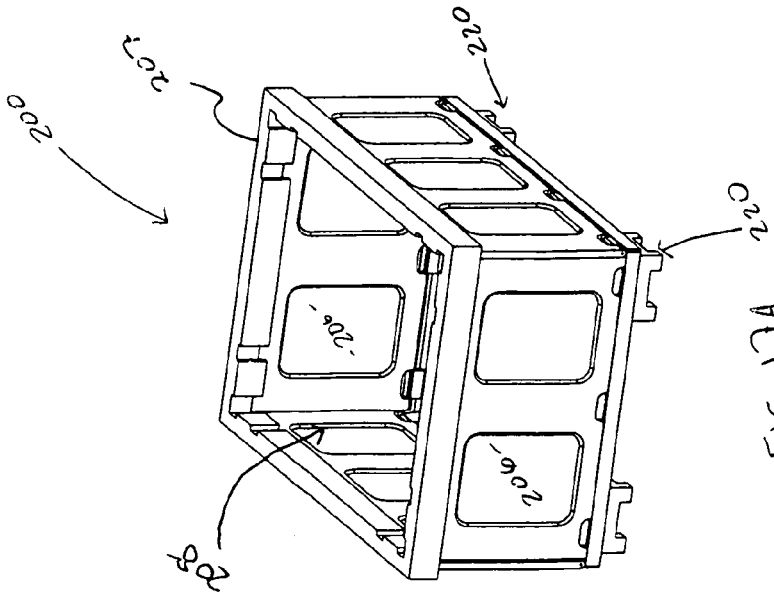
FIG. 17A is a perspective view of the embodiment of the storage assembly illustrated in FIG. 17.
Figure 18:
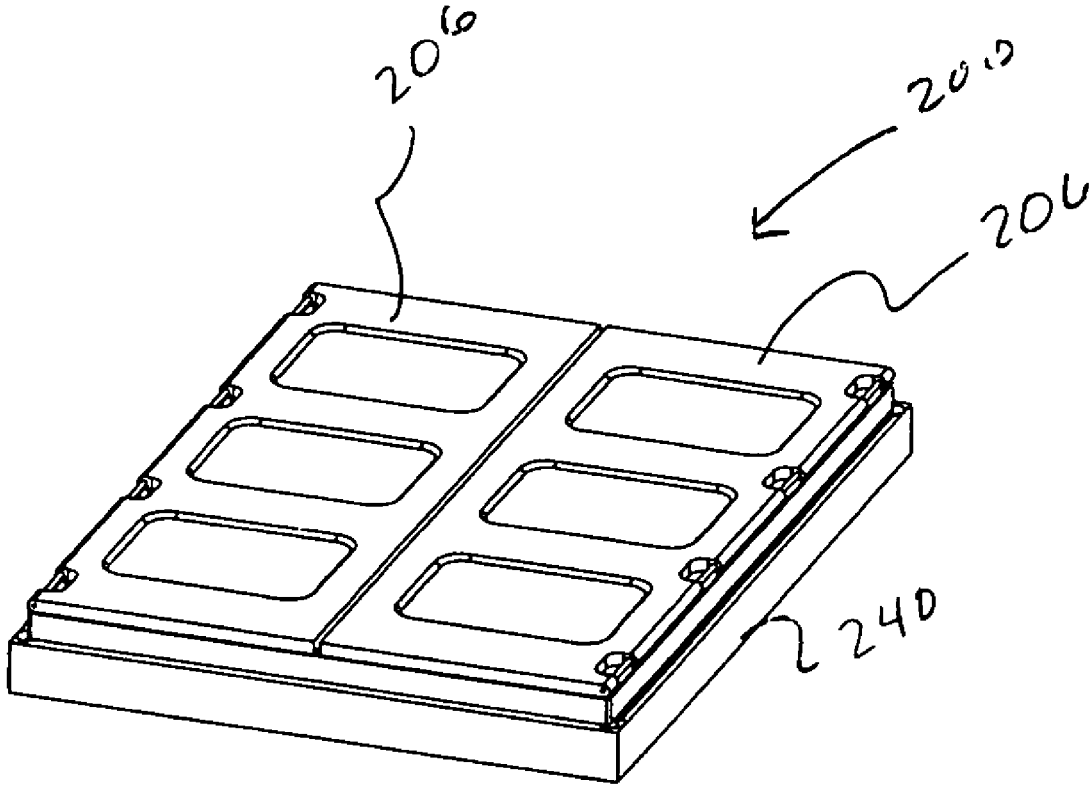
FIG. 18 is a perspective view of the embodiment of the storage assembly illustrated in FIGS. 17 and 17A disposed in a collapsed orientation.

Referring now to FIGS. 17, 17A, and 18, in at least one embodiment, the wall(s) 206 of the present invention are disposed in a movable relation to the platform 240. For instance, as best shown in the exploded view of FIG. 17, the walls 206 in at least one embodiment are removably connected or secured to the platform 240, such as, via hinges, clips, snaps, or virtually any other coupling assembly. Once assembled, the walls 206 may be locked into place via a locking mechanism 207, which, in at least one embodiment, includes a perimeter overlay as illustrated in FIG. 17A. Once in place, the locking mechanism 207 is structured and disposed to secure the walls 206 in a surrounding relation to the platform 240 so as to define the at least partially hollow interior compartment 208. The walls 206, platform 240, locking mechanism 207, and/or other portions of at least one embodiment of the storage assembly 200 may be disassembled or otherwise collapsed as illustrated in FIG. 18. The collapsible configuration is structured to facilitate storing and/or transferring of the storage assembly 200.

Figure 19:
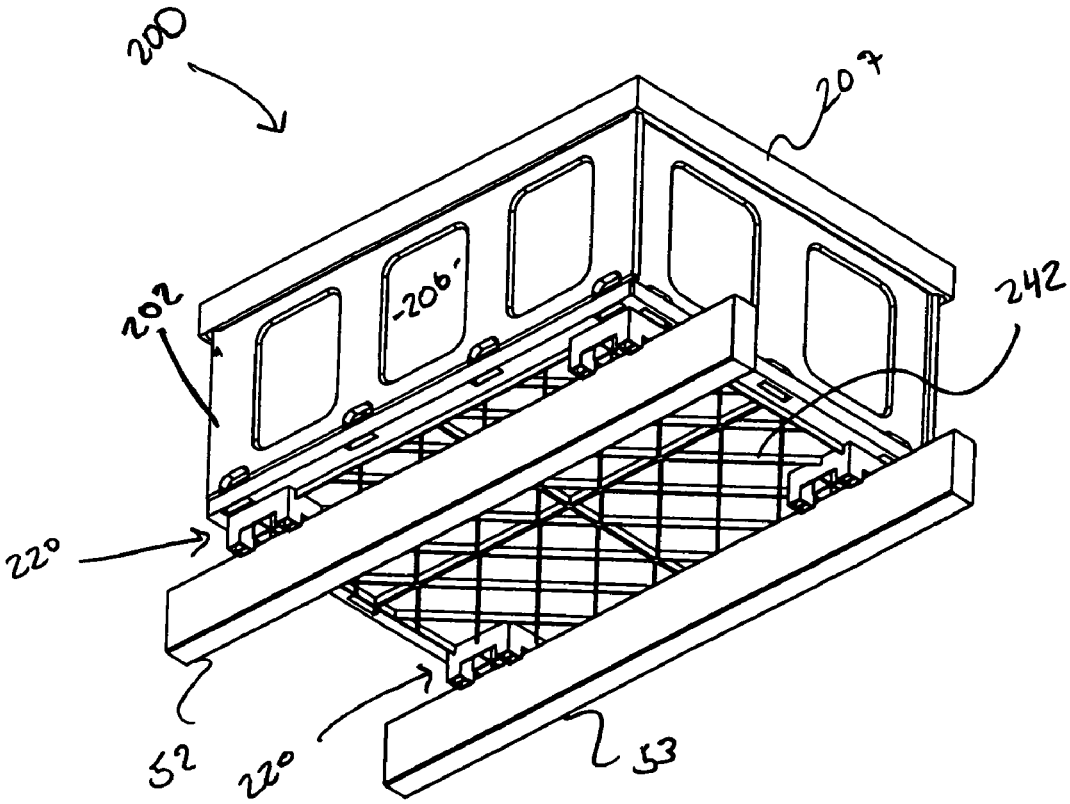
FIG. 19 is a perspective view of at least one other embodiment of the storage assembly disclosed in accordance with the present specification.

Furthermore, as best illustrated in FIG. 19, in at least one embodiment, a bottom surface of the platform 240 includes a grid-like structure 242 or other like configuration. As such, the mounting device(s) 220 may be cooperatively structured to allow the mounting device(s) 220 to be selectively disposed along the bottom surface of the platform 240, such as, for example, along the grid-like structure 242 thereof. Of course, the cooperative structuring of the platform 240 and the mounting device(s) 220 to allow selective positioning of the mounting device(s) 220 thereon is in no way limited to the grid-like structure illustrated in FIG. 19.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A storage assembly structured to be supported on a base, the base including a plurality of spaced apart beams, said storage assembly comprising:

a platform, a plurality of at least four mounting devices attached to said platform and cooperatively disposed thereon to removably support said platform on two adjacent beams in either of at least two supported orientations, said at least two supported orientations distinguishable by a variable spacing between the two adjacent beams, each of said plurality of mounting devices comprising a plurality of at least four stabilizing portions and at least one support portion, said stabilizing portions each extending outwardly from said support portion, wherein said stabilizing portions are disposable in a facing relation to opposite sides of a corresponding beam disposed in either of at least two transverse positions relative to said support portion, and wherein at least one of said plurality of mounting devices is disposed in an engaging relation with the base and at least a different one of said plurality of mounting devices is disposed in a non-operative relation with the base at least while said platform is supported on at least two of the spaced apart beams in either of said at least two supported orientations.

2. The storage assembly recited in claim 1 wherein said plurality of at least four mounting devices are integrally affixed to said platform.

3. The storage assembly recited in claim 1 wherein said plurality of at least four mounting devices are removably attached to said platform.

4. The storage assembly as recited in claim 1 further comprising a plurality of walls disposed in a surrounding relation to said platform, said platform and said plurality of walls being cooperatively structured and disposed to define a storage receptacle comprising an at least partially hollow interior compartment.

5. A storage assembly structured to be supported on a base, the base including a plurality of spaced apart beams, said storage assembly comprising:

a platform, a plurality of walls disposed in a surrounding relation to said platform, said platform and said plurality of walls being cooperatively structured and disposed to define a storage receptacle including an at least partially hollow interior compartment, a plurality of mounting devices attached to said storage receptacle, and said plurality of mounting devices comprising an attachment mechanism removably engaging the base on two beams in either of at least two supported orientations, said at least two supported orientations distinguishable by a variable spacing between the two adjacent beams, wherein at least two of the plurality of mounting devices are disposed in an operative, engaging relation with the base and at least one of the plurality of mounting devices is disposed in a non-operative, non-engaging relation with the base, at least while said storage receptacle is supported on the spaced apart beams in either of said at least two supported orientations.

6. The storage assembly recited in claim 5 wherein said attachment mechanism comprises a support portion disposed in confronting, supported relation to a top of a corresponding one of the beams.

7. The storage assembly recited in claim 6 wherein said attachment mechanism further comprises at least one stabilizing portion extending outwardly from said support portion in facing relation to a side of the corresponding beam.

8. The storage assembly recited in claim 7 wherein said attachment mechanism further includes a plurality of stabilizing portions.

9. The storage assembly recited in claim 5 wherein said plurality of mounting devices comprise an elongate configuration disposed substantially across said least one platform.

10. The storage assembly recited in claim 9 wherein said plurality of mounting devices are disposed in a substantially parallel relation to one another.

11. The storage assembly recited in claim 5 wherein said plurality of walls are disposed in a movable relation to said at least one platform.

12. The storage assembly recited in claim 5 further comprising at least one covering assembly cooperatively structured to at least partially enclose said at least partially hollow interior compartment.

* * * * *